US012089695B2

(12) United States Patent
Bidal et al.

(10) Patent No.: US 12,089,695 B2
(45) Date of Patent: Sep. 17, 2024

(54) ASYMMETRICAL HEEL PAD

(71) Applicant: Acushnet Company, Fairhaven (MA)

(72) Inventors: Jean-Marie Bidal, Bridgewater, MA (US); Paul O. Teeter, Pembroke, MA (US)

(73) Assignee: Acushnet Company, Fairhaven, MA (US)

( * ) Notice: Subject to any disclaimer, the term of this patent is extended or adjusted under 35 U.S.C. 154(b) by 69 days.

(21) Appl. No.: 17/529,864

(22) Filed: Nov. 18, 2021

(65) Prior Publication Data

US 2023/0148709 A1 May 18, 2023

(51) Int. Cl.

| | |
|---|---|
| ***A43B 23/08*** | (2006.01) |
| ***A43B 5/00*** | (2022.01) |
| ***A43B 7/144*** | (2022.01) |
| ***A43B 7/149*** | (2022.01) |
| ***A43B 7/20*** | (2006.01) |
| *A43D 25/20* | (2006.01) |

(52) U.S. Cl.

CPC ..... *A43B 23/088* (2013.01); *A43B 5/001* (2013.01); *A43B 7/144* (2013.01); *A43B 7/149* (2013.01); *A43B 7/20* (2013.01); *A43B 23/08* (2013.01); *A43D 25/20* (2013.01)

(58) Field of Classification Search

CPC ..... A43B 23/08; A43B 23/088; A43B 7/14; A43B 7/1405; A43B 7/141; A43B 7/1464

USPC ..... 36/88, 89, 93, 69

See application file for complete search history.

(56) References Cited

U.S. PATENT DOCUMENTS

| | | | | | |
|---|---|---|---|---|---|
| 2,104,048 | A * | 1/1938 | Marshall | A43B 9/02 | 36/68 |
| 2,159,762 | A * | 5/1939 | Hartwell | A43B 23/08 | 12/146 D |
| 2,212,515 | A * | 8/1940 | Engel | A43B 23/08 | 12/146 D |
| 3,750,310 | A * | 8/1973 | Messner | A43B 3/0047 | 36/117.6 |
| 4,308,673 | A * | 1/1982 | Mobius | D06N 3/10 | 12/146 D |
| 4,559,722 | A * | 12/1985 | Norton | A43B 5/06 | 36/105 |
| 4,704,808 | A * | 11/1987 | Bianchini | A43B 23/08 | 36/43 |
| 4,783,909 | A * | 11/1988 | Van Doren | A43B 3/242 | 36/68 |

(Continued)

*Primary Examiner* — Marie D Bays

(74) *Attorney, Agent, or Firm* — Lewis Roca Rothgerber Christie LLP

(57) ABSTRACT

Systems and methods for providing a golf shoe comprising a heel cup with an asymmetrical padding configuration to reduce foot movement during a golf swing. The asymmetrical padding configuration may include one or more heel pads that fit the contour of the heel area of the wearer's foot to provide proper support and fit to a golfer to reduce the voids of space that normally occur around the heel portion in a shoe. The support may lead to a better fit for increased comfort and more stability during the golf swing by reducing foot movement during the swing. The heel pad(s) may be provided between an outer and inner layer of material forming the shoe's upper and may be made of a variety of different materials that may give different stiffness and comfort to the heel area of the wearer's foot. In some examples, the shoe may be waterproof.

22 Claims, 12 Drawing Sheets

INSIDE/FRONT VIEW

(56) References Cited

U.S. PATENT DOCUMENTS

| | | | | | |
|---|---|---|---|---|---|
| 5,090,140 | A * | 2/1992 | Sessa | A43B 11/02 | 36/138 |
| 5,430,961 | A * | 7/1995 | Faulconer | A43B 3/0063 | 36/71 |
| 5,592,756 | A * | 1/1997 | Decker | A43B 7/14 | 36/89 |
| 6,079,128 | A * | 6/2000 | Hoshizaki | A43B 23/16 | 36/89 |
| 7,373,742 | B2 * | 5/2008 | Murphy | A43B 5/1616 | 36/89 |
| 2002/0083622 | A1 * | 7/2002 | Joubert | A43B 7/142 | 36/117.6 |
| 2005/0193594 | A1 * | 9/2005 | Murphy | A43B 23/088 | 36/89 |
| 2011/0119808 | A1 * | 5/2011 | Sherman | A61F 5/0111 | 36/71 |
| 2011/0185592 | A1 * | 8/2011 | Nishiwaki | A43B 23/17 | 36/69 |
| 2012/0216422 | A1 * | 8/2012 | Ikezawa | A43C 1/00 | 36/83 |
| 2015/0289589 | A1 * | 10/2015 | Nishiwaki | A43B 13/141 | 36/92 |
| 2018/0064204 | A1 * | 3/2018 | Vallon | A43B 23/17 | |
| 2021/0259364 | A1 * | 8/2021 | Takashima | A43B 23/0275 | |
| 2023/0117040 | A1 * | 4/2023 | Perrin | A43B 7/20 | 36/71 |

* cited by examiner

TOP VIEW

BACK VIEW

BOTTOM VIEW

INSIDE/FRONT VIEW

INSIDE/FRONT VIEW

INSIDE/FRONT VIEW

INSIDE/FRONT VIEW

ASYMMETRICAL HEEL PAD

BACKGROUND

Having the proper equipment when playing a sport can be a factor in how well an athlete may perform. For example, proper equipment in the sport of golf may allow a golfer to hit the golf ball longer, straighter, and more consistently, thus improving the golfer's performance and overall score. Golf shoes are one example piece of equipment that can substantially affect a golfer's performance. For example, traction, stability, and support provided by a golfer's shoes can affect how the golfer is able to perform the body movements necessary to culminate in an ideal contact between a club head and a ball (i.e., a golf swing). If the shoes do not fit the golfer properly, the golfer's foot can move relative to the ground, which is undesirable. For example, increased movement of the foot during the golf swing can lead to less power during the swing and less accuracy in the golf shot.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe a golf shoe comprising a heel cup comprising an asymmetrical padding configuration to reduce foot movement during a golf swing. The asymmetrical padding configuration may include one or a plurality of heel pads that fit the contour of the heel area of the wearer's foot. For example, the one or more heel pads may have an asymmetrical configuration so that the heel area provides proper support and fit to a golfer to reduce the voids of space that normally occur around the heel portion in a shoe. The support may lead to a better fit for increased comfort and more stability during the golf swing by reducing foot movement during the swing. The decreased movement of the foot during the golf swing can lead to more power during the swing and greater accuracy in the golf shot.

In an example, the technology relates to a golf shoe comprising: an upper, the upper comprising: a forepart region; and a heel cup attached to the forepart region, the heel cup comprising: an interior surface; an exterior surface; and at least one heel pad molded between the interior surface and the exterior surface, the at least one heel pad comprising a medial side and a lateral side, wherein the medial side is asymmetrical to the lateral side; and a sole attached to the upper.

In another example, the technology relates to a heel cup, comprising an interior surface; an exterior surface; and a heel pad molded between the interior surface and the exterior surface, the heel pad comprising a medial side and a lateral side, wherein the medial side of the heel pad is asymmetrical to the lateral side of the heel pad.

In another example, the technology relates to a method for making a golf shoe, comprising: constructing a forepart region of an upper; constructing a heel region of the upper, the heel region comprising a heel cup with an asymmetrical heel pad configuration about a medial side and a lateral side of the heel cup; attaching the forepart region to the heel cup to form the upper; lasting the upper; and attaching a sole to the upper.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

DETAILED DESCRIPTION

Figure 1A:
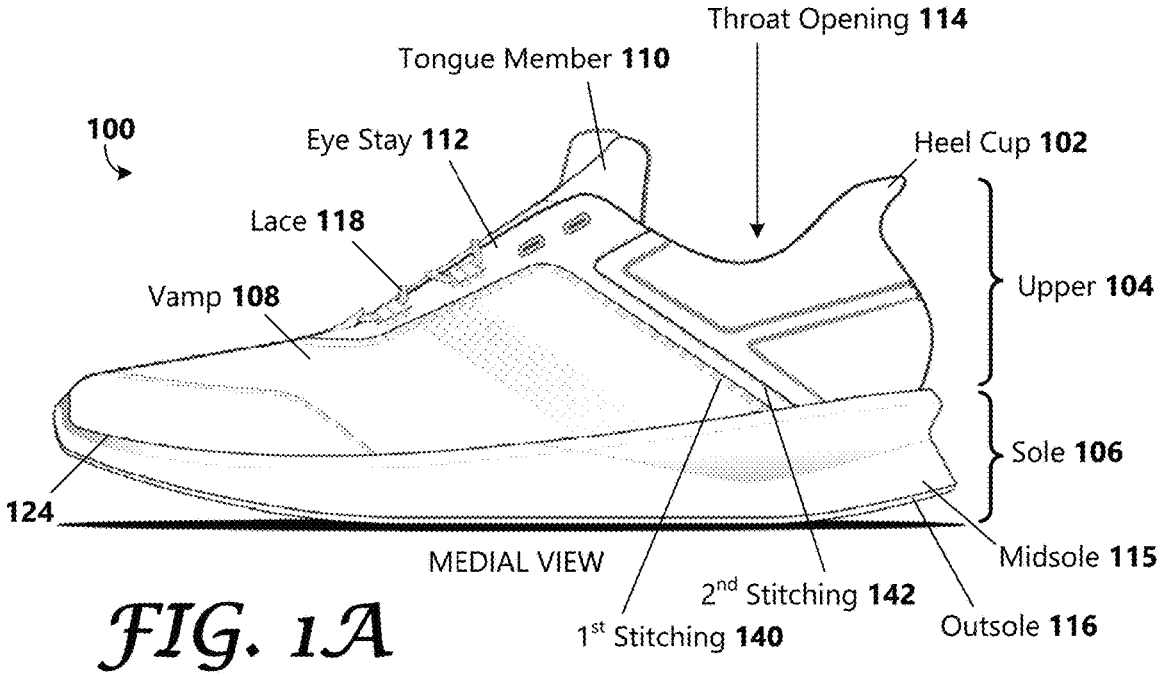
FIG. 1A depicts a medial side view of an example golf shoe in which an asymmetrical heel pad configuration may be implemented.

The present invention now will be described more fully in reference to the accompanying figures, in which embodiments of the invention are shown. However, this invention should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity. The views shown in the Figures are of a right shoe and it is understood the components for a left shoe will be mirror images of the right shoe. It also should be understood that the shoe may be made in various sizes and thus the size of the components of the shoe may be adjusted depending upon the shoe size.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "attached," "coupled" or "connected" to another element, it can be directly attached, coupled or connected to the other element or intervening elements may also be present. In contrast, when an element is referred to as being "directly attached," directly coupled" or "directly connected" to another element, there are no intervening elements present.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

As discussed above, golf shoes are an important part of a player's equipment, and lack of stability in the golf shoe may negatively impact a player's performance. One way in which golf shoes may not fit the golfer properly is in the heel area, where voids of space may be formed below the bony prominences located on each side of the golfer's ankles. Such voids of space occur commonly around the heel in golf shoes due at least in part to the asymmetrical configuration of the bony prominences between each side of the human ankle and the typically symmetrical configuration of the heel area of golf shoes. For example, each leg of the human body is supported by two bones: a tibia on the medial or inner side of the leg and the fibula on the lateral or outer side of the leg, and the bony prominence on each side of the human ankle is referred to as a malleolus. A medial malleolus is formed by the lower end of the tibia and is the prominence on the medial side of the ankle. A lateral malleolus, the prominence on the lateral side of the ankle, is formed by the lower end of the fibula and descends lower than the medial malleolus. Currently, padding provided in the heel area of golf shoes is typically symmetrical in design and does not account for the asymmetrical configuration of the medial and lateral malleolus. Thus, the symmetrical design of the padding may form a void in the heel area around the medial and/or lateral malleolus that may allow for movement of the wearer's foot. It may be desirable, therefore, to provide a golf shoe that fits the contour of the wearer's heel area for reducing foot movement during a golf swing.

Additionally, given that the sport of golf is an outdoor sport, a golfer may sometimes play in wet and/or soggy conditions. The sport of golf includes stretches of walking, which if a golfer's shoes are not waterproof, the golfer's foot can get wet. As can be appreciated, this may not only be uncomfortable to the golfer, but in certain locations and/or during low temperature conditions, can be unsafe for the golfer. It may be desirable, therefore, to provide a golf shoe that is waterproof for keeping the wearer's foot dry during wet or soggy conditions.

To help alleviate the above problems, the examples of the present disclosure describe a golf shoe comprising an asymmetrical heel padding configuration to reduce foot movement during a golf swing. The asymmetrical heel padding configuration may include one or a plurality of heel pads that fit the contour of the heel area of the wearer's foot. For example, the one or more heel pads may have an asymmetrical configuration so that the heel area provides proper support and fit to a golfer to reduce the voids of space that normally occur around the heel portion in a shoe. The support may lead to a better fit for increased comfort and more stability during the golf swing by reducing foot movement during the swing. The decreased movement of the foot during the golf swing can lead to more power during the swing and greater accuracy in the golf shot.

Figure 1B:
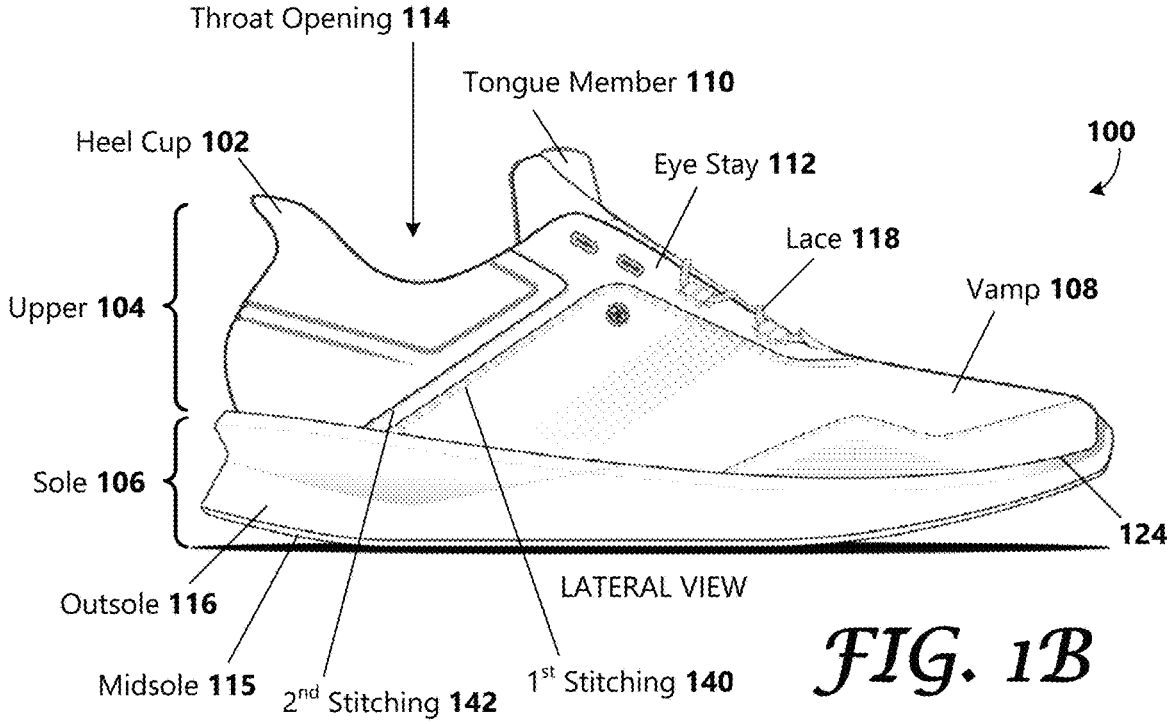
FIG. 1B depicts a lateral side view of the example golf shoe of FIG. 1A.
Figure 1C:
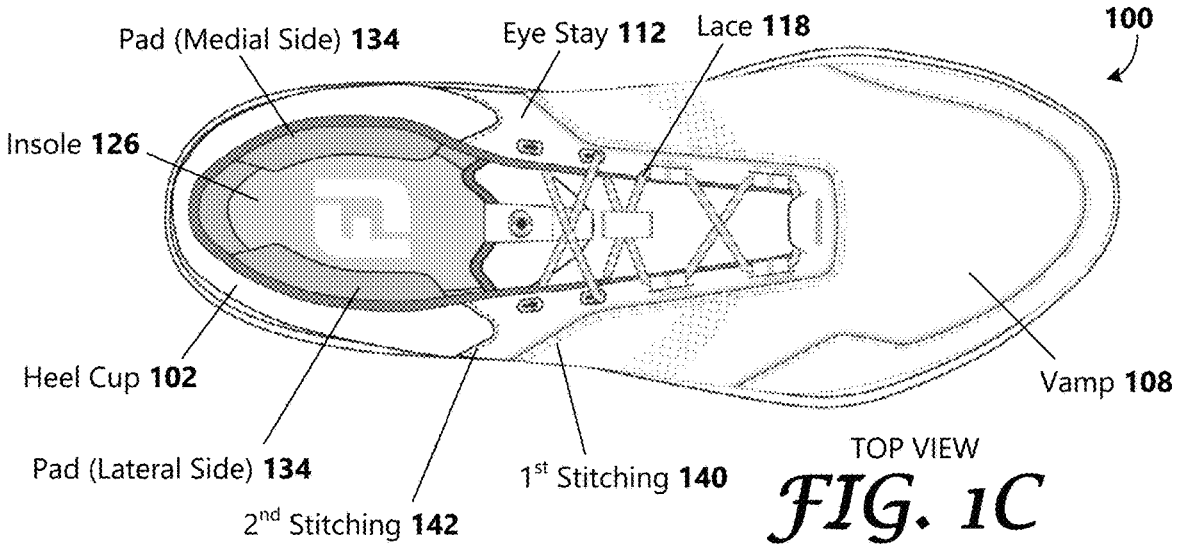
FIG. 1C depicts a top view of the example golf shoe of FIG. 1A.
Figure 1D:
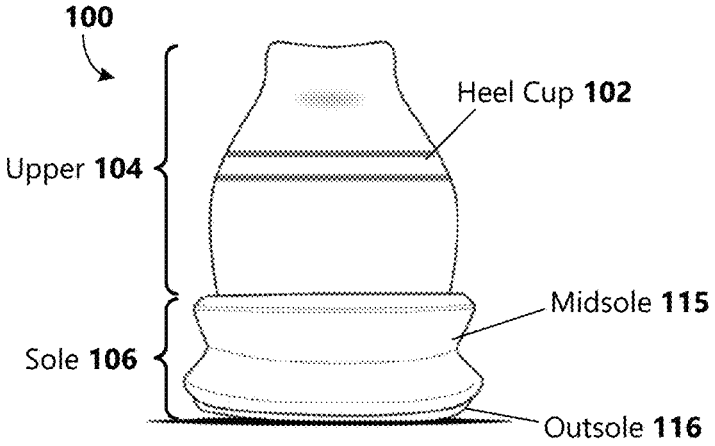
FIG. 1D depicts a back view of the example golf shoe of FIG. 1A.
Figure 1E:
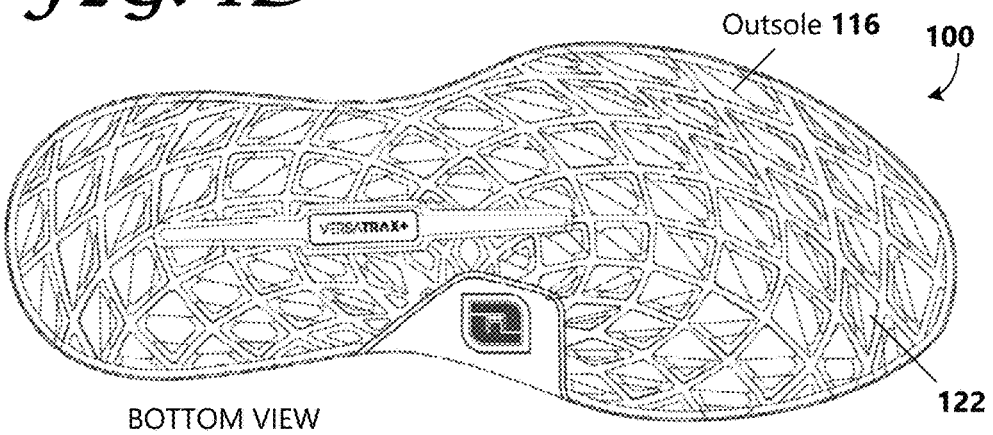
FIG. 1E depicts a bottom view of the example golf shoe of FIG. 1A.

FIGS. 1A-1E depict various views of an example golf shoe 100, sometimes referred to herein generally as a shoe, in which aspects of a heel cup 102 comprising an asymmetrical heel padding configuration may be implemented. For example, FIG. 1A is a medial (e.g., inner) side view of the shoe 100, FIG. 1B is a lateral (e.g., outer) side view of the of the shoe 100, FIG. 1C is a top view of the of the shoe 100, FIG. 1D is a back view of the shoe 100, and FIG. 1E is bottom view of the shoe 100.

The shoe 100 may generally include a shoe upper 104 and a sole 106. The upper 104 may have a traditional shape and may be made from a combination of standard upper materials such as, for example, natural leather, synthetic leather, knits, non-woven materials, natural fabrics, and synthetic fabrics. For example, breathable, mesh, and synthetic textile fabrics made from nylons, polyesters, polyolefins, polyurethanes, rubbers, foams, and combinations thereof can be used. The material used to construct the upper may be selected based on desired properties such as breathability, durability, flexibility, comfort, and water resistance. In one example, the shoe 100 may be waterproof, and the forepart region of the upper 104 and at least an outermost layer of the upper 104 may be constructed of one or a combination of materials having water resistant properties. Additional waterproofing features (described below) may be applied in construction of the shoe 100 for providing additional waterproofing capabilities.

The forepart region of the upper 104 may include a forefoot and midfoot region that generally correspond with a front and a middle of the wearer's foot (e.g., the area surrounding the toes and metatarsal, phalange, and sesamoid bones and the area surrounding the arch and the navicular, cuboid, and cuneiform bones). It is understood that the heel region and forepart region (i.e., forefoot and midfoot regions) are intended to represent general areas of footwear and not demarcate precise areas. The forepart region of the upper 104 may include a vamp 108 for covering the forepart region of the foot. In some examples, the vamp 108 may cover at least a portion of a tongue member 110. In other examples, and as shown in the various Figures, the forepart region of the upper 104 may further include an eye stay 112 that may be attached to the vamp 108 and that may cover at least a portion of the tongue member 110.

The shoe 100 may have a medial side and a lateral side that are opposite to one another. The medial side may generally correspond with an inside area of the wearer's foot and a surface that faces toward the wearer's other foot. The lateral side may generally correspond with an outside area of the wearer's foot and a surface that faces away from the wearer's other foot. The wearer's foot may be inserted into the shoe 100 through a throat opening 114 defined in the upper 104. In the examples, the throat opening 114 may be defined by the heel cup 102 and the tongue member 110. In other examples, the throat opening 114 may be defined by the heel cup 102, the vamp 108, and the tongue member 110. In still other examples and as illustrated in the various Figures, the throat opening 114 may be defined by the heel cup 102, the eye stay 112, and the tongue member 110. A lace 118 or another tightening system may be used for tightening the shoe around the contour of the wearer's foot. The lace 118 may be threaded through eyelets or eyes of the eye stay 112.

The heel region of the upper 104 may generally correspond with the rear portions of a wearer's foot (e.g., the area surrounding and below the Achilles tendon, the posterior of the heel, and the talus and calcaneus bones). In an example implementation, the heel region of the upper 104 includes the heel cup 102. According to an example, the heel cup 102 may be comprised of a plurality of layers that may be molded together to form the heel cup 102, as discussed further below. For instance, the heel cup 102 may be formed as a single molded element made up of a plurality of layers.

Figures 2A, 2B, 2C, 2D:
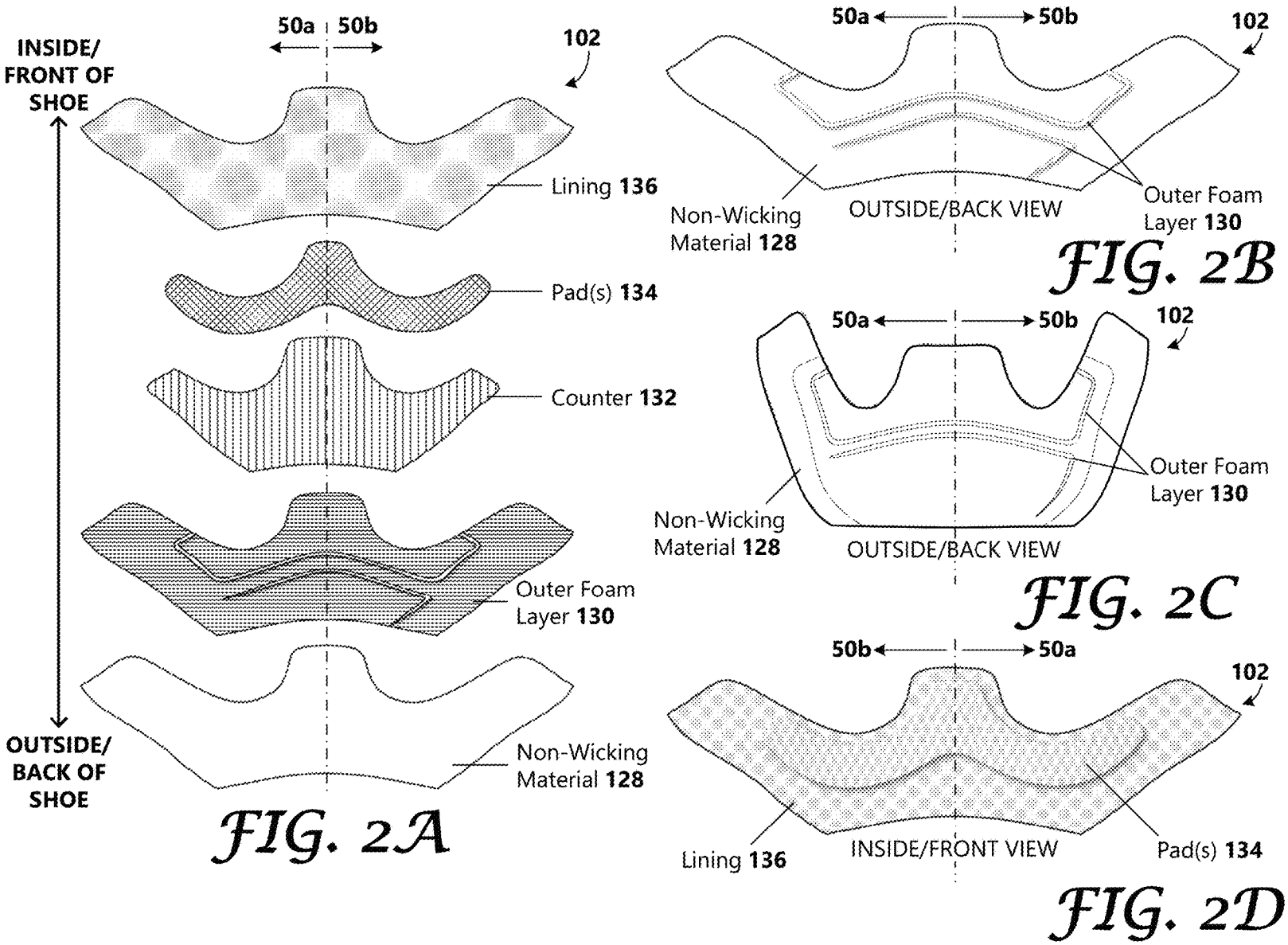
FIG. 2A depicts an exploded view of various layers that may be used to form an example heel cup for the example golf shoe of FIG. 1A according to an example.
FIG. 2B depicts an outside (or back) view of the various layers of the example heel cup of FIG. 2A arranged together in a flattened form.
FIG. 2C depicts an outside (or back) view of the example heel cup of FIG. 2A arranged together in a curved form.
FIG. 2D depicts an inside (or front) view of the various layers of the example heel cup of FIG. 2A arranged together in a flattened form.

Example layers that may be used to form the heel cup 102 are illustrated in exploded views in FIGS. 2A and 2E-H. As should be appreciated, the example layers in FIGS. 2A and 2E-H are illustrated for better clarity and understanding of aspects of the shoe 100. For example, the example layers in FIG. 2A are shown having shapes and contours that may not be present until after a molding process (e.g., sizes, dimensions, and configurations of the various layers, such as illustrated in FIG. 2A, may be formed through the molding process). Other example shapes and contours of layers of the heel cup 102 prior to the molding process are represented in FIGS. 2E-H. An outside (or back) view of the example layers of the heel cup 102 arranged together in a flattened form is shown in FIG. 2B, an outside (or back) view of the heel cup 102 in a curved form, for example, in the form in which the heel cup 102 may be attached to the forepart region of the upper 104, is shown in FIG. 2C, and an inside (or front view, e.g., from the front of the shoe 100)) of the example layers of the heel cup 102 arranged together in a flattened view is shown in FIG. 2D.

With reference to FIGS. 2A-H, the heel cup 102, and thus, the layers of the heel cup 102, may have a medial side 50*a* and a lateral side 50*b* that correspond to the medial side and the lateral side of the shoe 100. A first layer, which may be the outermost layer or the outer surface of the heel cup 102, may be a non-wicking material 128. For example, the non-wicking material 128 may be a material that does not absorb moisture as part of providing a waterproof shoe 100. The non-wicking material 128 may wrap around the heel region and extend forward along both the medial side 50*a* and the lateral side 50*b*.

In some examples, a next layer of the heel cup 102 may include an outer foam layer 130. The outer foam layer 130 may be included to provide an embossed decorative pattern in the heel cup 102. For example, the outer foam layer 130 may be a foam pad comprised of one or a combination of pieces and may be of various shapes, sizes, and configurations. As shown in FIGS. 2B and 2C, when the various layers of the heel cup 102 are arranged and molded together, the outer foam layer 130 may provide a three-dimensional (3D) pattern on the non-wicking material 128.

A next layer of the heel cup 102 may include a counter 132. The counter 132 may reinforce the heel cup 102 and the upper 104 and, in some examples may limit movement of the wearer's heel. The counter 132 may wrap around the heel region and extend forward along both the medial side 50*a* and the lateral side 50*b*.

Figure 4:
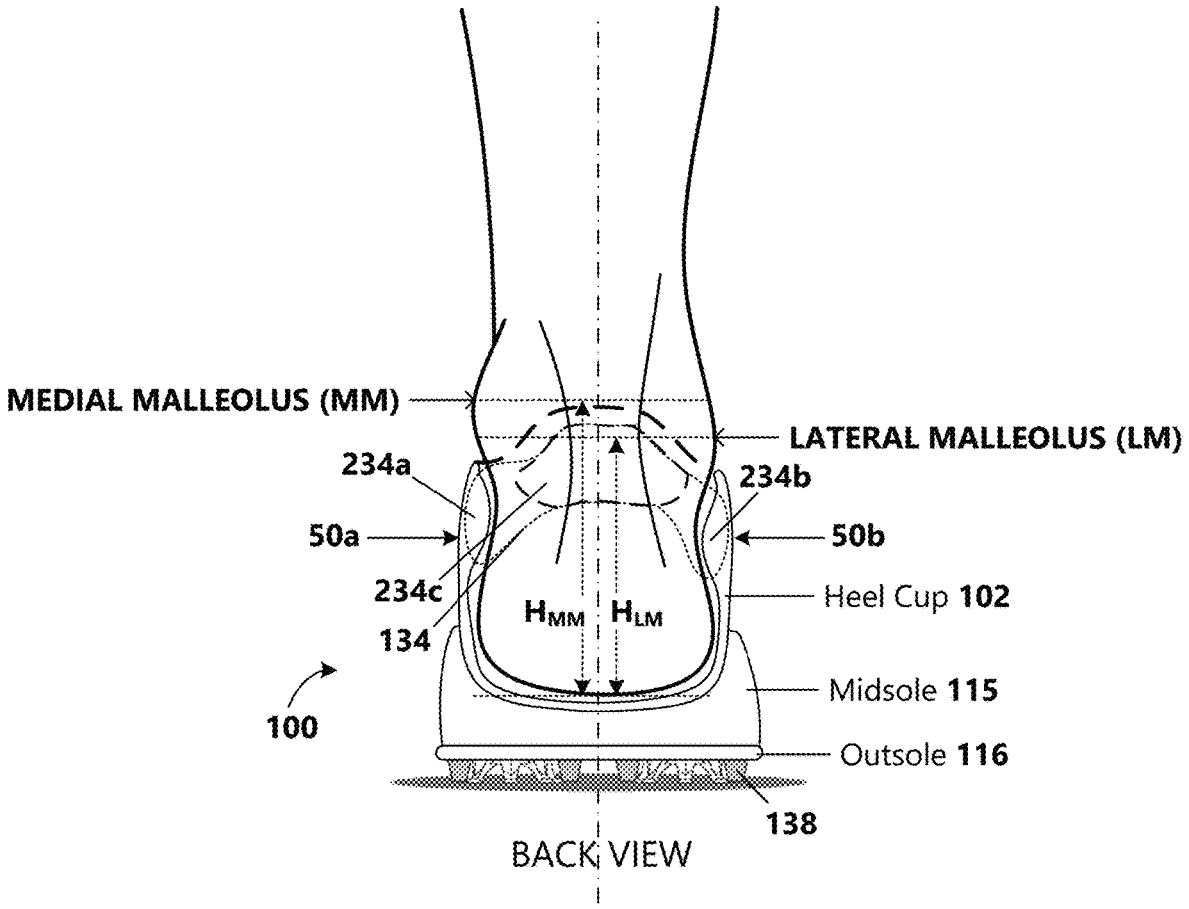
FIG. 4 depicts a back view of an example golf shoe shown on a wearer's foot.

A next layer of the heel cup 102 may include an inner foam layer that may be molded to form one or a plurality of heel pads 134,234,334,434. The one or more heel pads 134,234,334,434 are described in detail below with reference to FIGS. 5A-D. As shown in an outside (or back) view of an example shoe 100 worn by a wearer in FIG. 4, the heel pad(s) 134,234 may be included to add comfort around the wearer's ankle during wear. As described above, the medial malleolus formed by the lower end of the tibia is the prominence on the medial side of the wearer's ankle, and the lateral malleolus formed by the lower end of the fibula is the prominence on the lateral side of the ankle. As shown in FIG. 4, the height $H_{MM}$ of the medial malleolus from the bottom of the wearer's foot is greater than the height $H_{LM}$ of the lateral malleolus. In examples, the heel pad(s) 134,234, 334,434 may have an asymmetrical configuration about the medial side 50*a* and the lateral side 50*b* of the heel cup 102 to reduce the voids of space that can normally occur around the heel region in a shoe 100 due to the asymmetrical heights $H_{MM}$,$H_{LM}$ of the medial malleolus and the lateral malleolus. Accordingly, the shoe 100 may better fit the contour of the wearer's heel area for reducing foot movement during a golf swing.

Returning to FIGS. 2A-2H, a last layer, which may be the innermost layer or interior surface of the heel cup 102, may include a lining 136. For example, the lining 136 may be used to line the inside of the heel cup 102 and improve comfort of the shoe 100. The lining 136 may wrap around the heel region and extend forward along both the medial side 50*a* and the lateral side 50*b*. As shown in FIG. 2D, when the various layers of the heel cup 102 are arranged together, the one or more heel pads 134,234,334,434 included in the inner foam layer may provide 3D asymmetrical heel padding in the lining 136. For example, after the various layers of the heel cup 102 are molded together and assembled to the shoe 100, the 3D asymmetrical heel padding provided by the heel pad(s) 134,234,334,434 may fit the contour of the wearer's heel area.

Figure 2F:
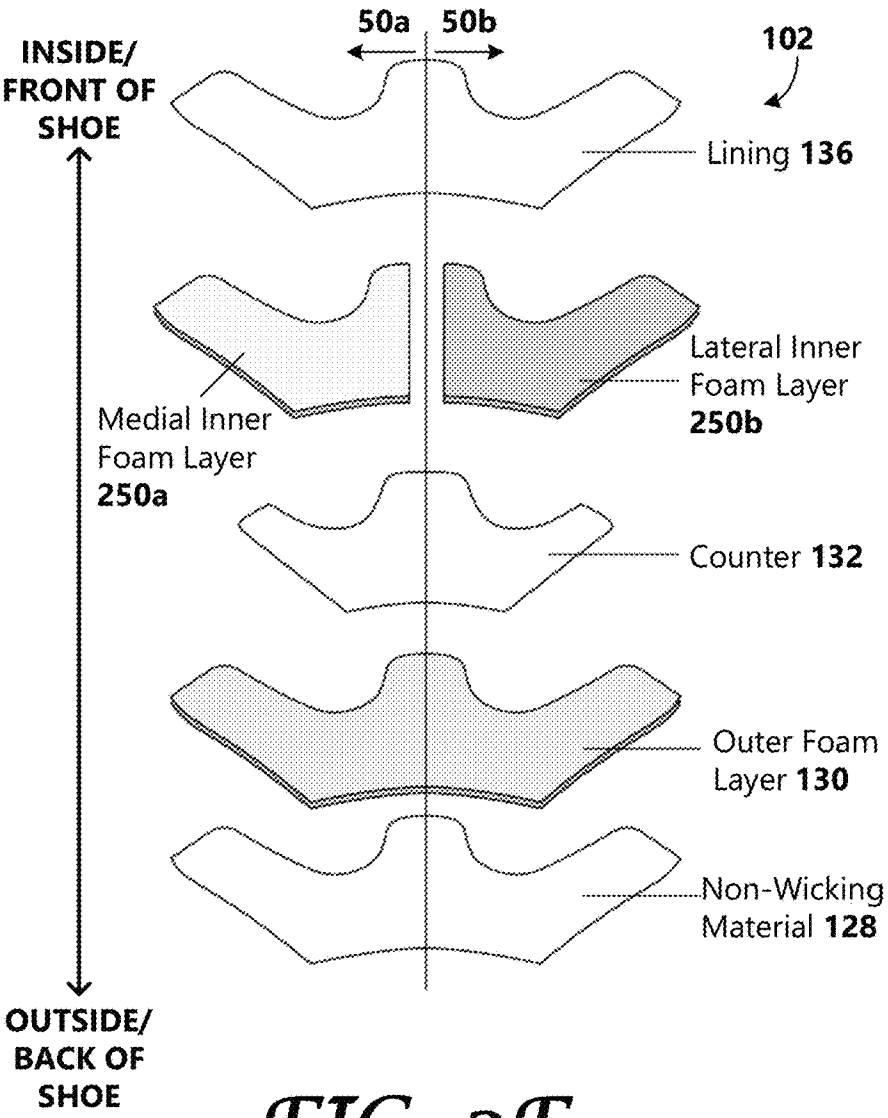
FIG. 2F depicts an exploded view of various example layers that may be used to form an example heel cup comprising a dual density asymmetrical heel pad configuration for the example golf shoe of FIG. 1A according to another example.
Figure 2E:
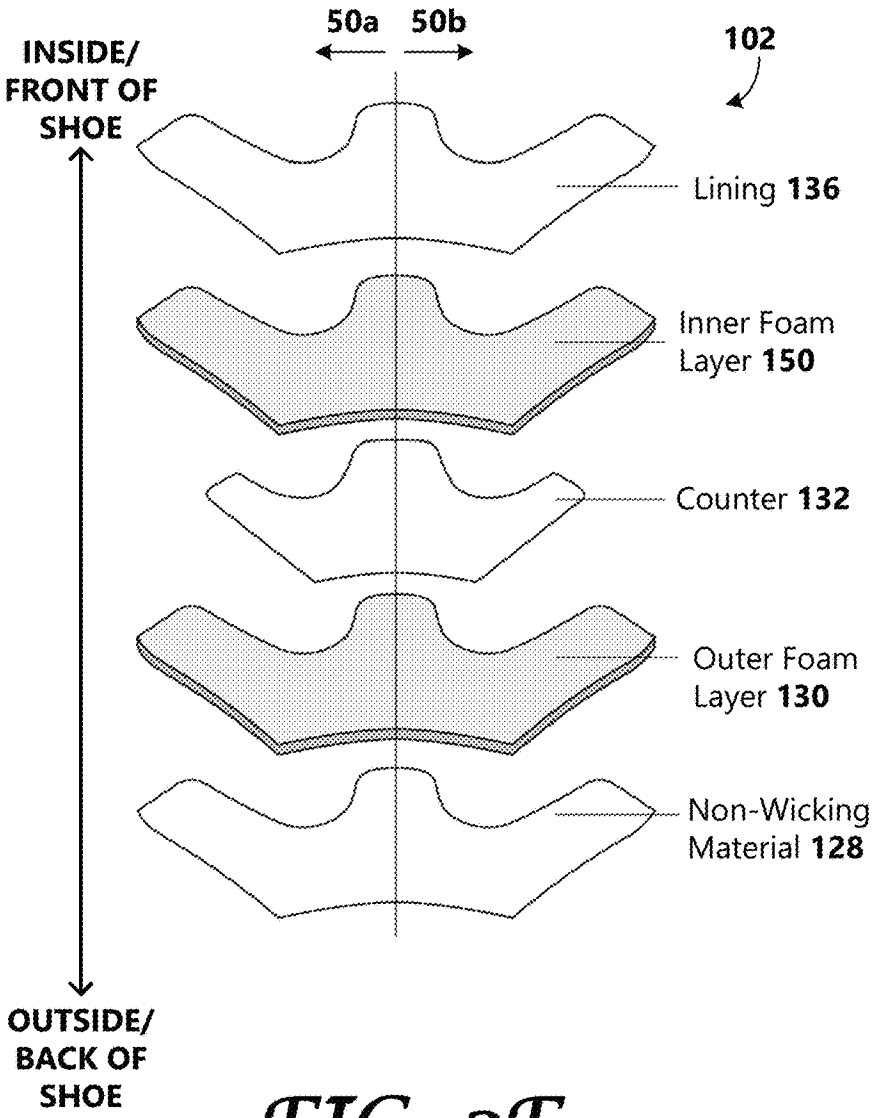
FIG. 2E depicts an exploded view of various example layers that may be used to form an example heel cup for the example golf shoe of FIG. 1A according to another example.

FIGS. 2E-H show different examples of layering of the heel cup 102 described in FIG. 2A. For example, FIG. 2E shows an example heel cup layer configuration comprising a single inner foam layer 150 that may be formed to create the one or more heel pads 134,234,334,434. For instance, the first layer (e.g., the outermost layer or the outer surface of the heel cup 102) may be a non-wicking material 128; the next (e.g., second) layer may include the outer foam layer 130 to provide an embossed decorative pattern in the heel cup 102 when the various layers of the heel cup 102 are arranged and molded together, the next (e.g., third) layer may include the counter 132 to reinforce the heel cup 102; the next (e.g., fourth) layer may include the single inner foam layer 150, that when molded, includes at least one or a plurality of heel pads 134,234,334,434 configured asymmetrically about the medial side 50*a* and the lateral side 50*b* of the heel cup 102 to reduce the voids of space that can normally occur around the heel region in a shoe 100 due to the asymmetrical configuration of the wearer's medial malleolus and the lateral malleolus; and the next (e.g., fifth or last) layer, which may be the innermost layer of the heel cup 102, may include the lining 136 that may be used to line the inside of the heel cup 102 and improve comfort of the shoe 100.

FIG. 2F shows an example heel cup layer configuration comprising a dual density inner foam layer 250*a,b* (generally, 250) that may be formed to create one or more heel pads 134,234,334,434 having dual density properties. For instance, the dual density inner foam layer 250*a,b* may be comprised of a medial inner foam layer 250*a* having a first density and a lateral inner foam layer 250*b* having a second density higher than the first density. For example, the higher density of the lateral inner foam layer 250*b* may provide additional support along the lateral side of the wearer's foot, which can reduce foot movement during a golf swing.

Figure 2H:
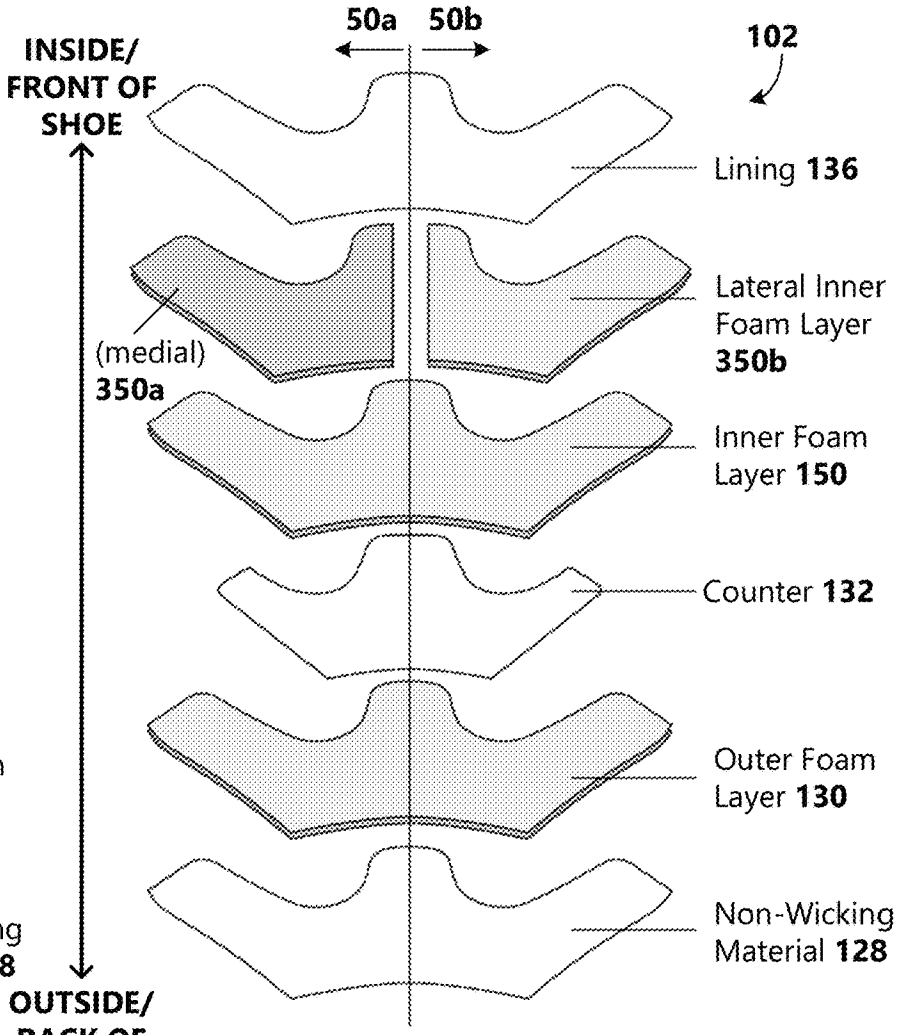
FIG. 2H depicts an exploded view of various example layers that may be used to form an example heel cup comprising a triple density asymmetrical heel pad configuration for the example golf shoe of FIG. 1A according to another example.
Figure 2G:
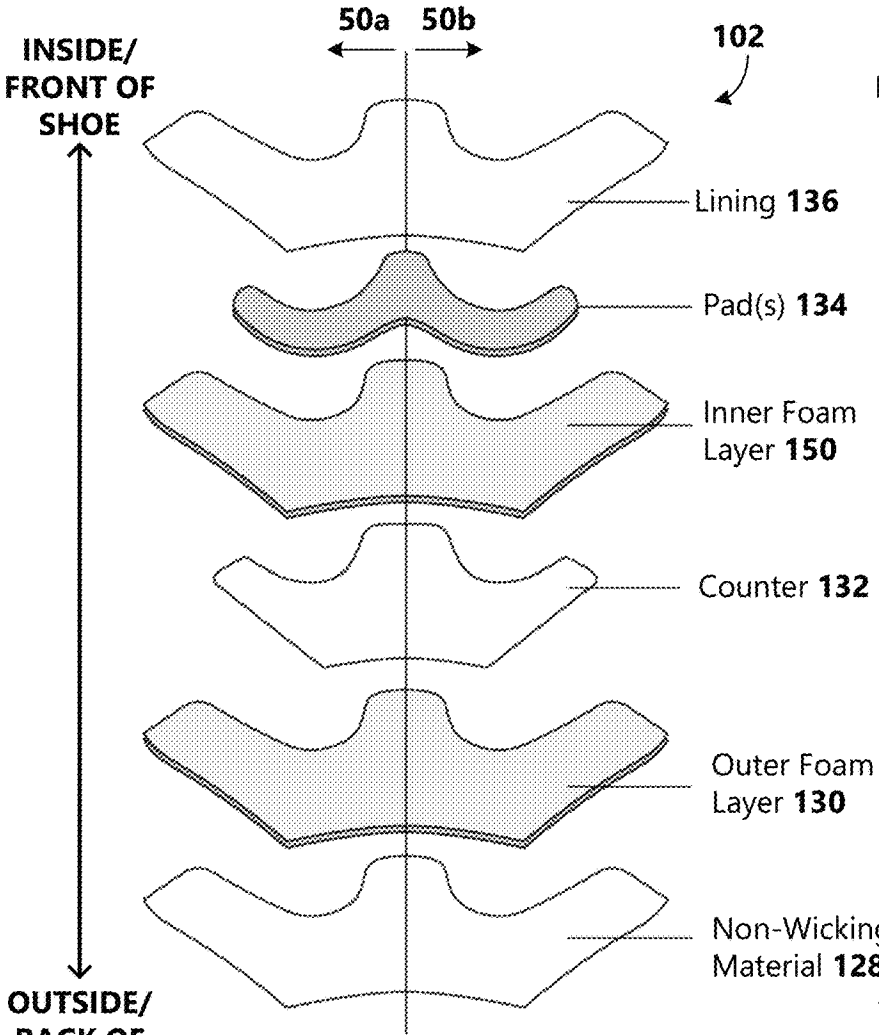
FIG. 2G depicts an exploded view of various example layers that may be used to form an example heel cup comprising a pre-formed asymmetrical heel pad configuration for the example golf shoe of FIG. 1A according to another example.

FIG. 2G shows an example heel cup layer configuration comprising an inner foam layer 150 and one or a plurality of heel pads 134,234,334,434 that may be pre-formed (e.g., die cut) and positioned between the inner foam layer 150 and the lining 136. For example, the one or more heel pads 134, 234,334,434 may be arranged asymmetrically about the medial side 50*a* and the lateral side 50*b* of the heel cup 102, such that when the various layers of the heel cup 102 shown in FIG. 2G are molded together, the one or more heel pads 134,234,334,434 may be formed to support the wearer's foot by reduce the voids of space that can normally occur around the heel region in a shoe 100 due to the asymmetrical configuration of the wearer's medial malleolus and the lateral malleolus.

FIG. 2H shows an example heel cup layer configuration comprising a first inner foam layer 150 and a dual density inner foam layer 350*a,b* (generally, 350) that may be formed to create one or more heel pads 134,234,334,434 having triple density properties. For instance, the dual density inner foam layer 350*a,b* may be comprised of a medial inner foam layer 350*a* having a first density and a lateral inner foam layer 350*b* having a second density higher than the first density. In some examples and as shown, the medial inner foam layer 350*a* and the lateral inner foam layer 350*b* may be arranged such there a space may be defined between them. When the various layers of the heel cup 102 shown in FIG. 2H are molded together, the first inner foam layer 150 may fill the space between the medial inner foam layer 350*a* and the lateral inner foam layer 350*b*. For example, the first inner foam layer 150 may be configured to provide support in the center (i.e., between the medial side 50*a* and the lateral side 50*b*) of the heel cup 102, the medial inner foam layer 350*a* may be configured to form a medial side of the one or more heel pads 134,234,334,434, and the lateral inner foam layer 350*b* may be configured to form a lateral side of the one or more heel pads 134,234,334,434. Thus, when formed, the first inner foam layer 150 and the dual density inner foam layer 350 may provide a triple foam density heel pad configuration. It should be understood that the above-described layers shown in FIGS. 2A-H represent only one example of layers of materials that can be used in the heel cup 102 constructions of this disclosure and other layers of materials can be used without departing from the spirit and scope of this invention.

Figure 3:
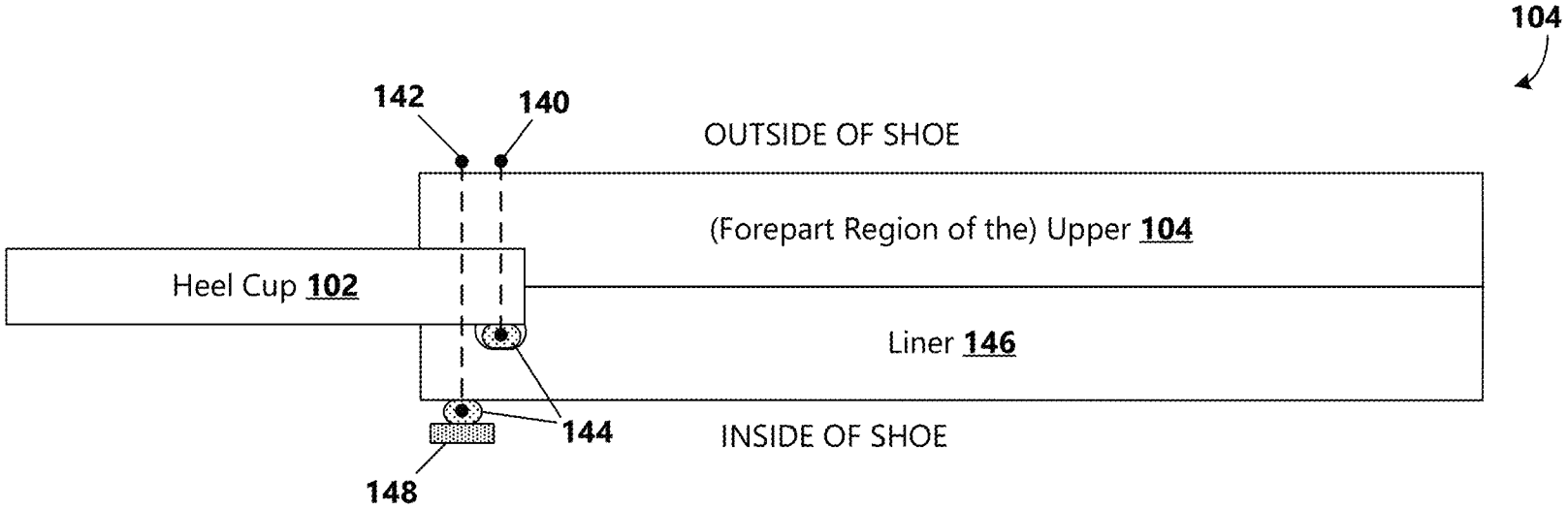
FIG. 3 depicts a schematic diagram of an upper of the example golf shoe including waterproofing features.

According to an aspect, after being molded together, the heel cup 102 may be attached to the forepart region of the upper 104. In one example, and as shown in a schematic diagram illustrated in FIG. 3, the heel cup 102 may be secured to the forepart region of the upper 104 via a first stitching 140. Additionally, one or a plurality of layers of cement 144 may be applied over the first stitching 140 to fill any holes made as part of the stitching for waterproofing the seam between the heel cup 102 and the forepart region of the upper 104. In some examples, a liner 146 may be included. The liner 146 may be used to line the inside of the forepart region of the upper 104 and improve comfort of the shoe 100. For example, the liner 146 may be attached to the inner side of the forepart region of the upper 104 and extend from the toe area of the shoe 100 to the heel cup 102. The liner 146 may be secured to the heel cup 102 via a second stitching 142. The liner 146 may cover the cement 144 applied over the first stitching 140. Additionally, a piece of hot melt adhesive 148 may be applied over the second stitching 142 to cover any holes made as part of the stitching for providing a waterproof shoe 100. The hot-melt adhesive 148 may be a hot melt tape or similar material. Another layer of cement 144 may also be used to fill in the holes caused by the second stitching 142, and the adhesive 148 may be applied over the other layer of cement 144. In one example implementation, this may complete the construction of the upper 104.

It should be understood that the above-described upper 104 shown in FIGS. 1A-D, 2A-D, and 3 represents only one example of an upper that can be used in the shoe 100 constructions of this disclosure; other uppers can be used without departing from the spirit and scope of this invention.

According to an example, the sole 106 may be comprised of an outsole 116, a midsole 115, and an insole 126. Some example soles 106 that can be incorporated in the shoe 100 are described in U.S. Pat. No. 11,019,874 titled "Golf Shoe Having Outsole with All-Surface Traction Zones" filed on Dec. 20, 2018, and U.S. Patent Application No. 2020/038, 3421 titled "Golf Shoe Having Midsole and Outsole for Providing Flex and Stability" filed Aug. 26, 2019, the disclosures of which are incorporated by reference herein in their entireties. The midsole 115 may be relatively lightweight and provides cushioning to the shoe 100. The midsole 115 may be made from a standard midsole material such as, for example, foamed ethylene vinyl acetate copolymer (EVA) or polyurethane. In one manufacturing process, the midsole 115 is molded on and about the outsole 116. Alternatively, the midsole 115 can be molded as a separate piece and then joined to the top surface (not shown) of the outsole 116 by stitching, adhesives, or other suitable fastening means using standard techniques known in the art. For example, the midsole 115 can be heat-pressed and bonded to the top surface of the outsole 116. It should be understood that the above-described midsole 115 shown in FIGS. 1A,1B,1D, and 4 represents only one example of a midsole that can be used in the shoe constructions of this invention and other midsoles can be used without departing from the spirit and scope of this invention.

In general, the outsole 116 is designed to provide stability and traction for the shoe 100. Referring back to FIG. 1E, the bottom surface of the outsole 116 is configured to contact the ground during golf play. The golf shoe 100 may include multiple traction members 122 that protrude from the bottom surface of the outsole 116 to help provide traction between the shoe 100 and grass on the course. The traction members 122 can be of various sizes and may further be of any suitable shape including, but not limited to, rectangular, triangular, square, spherical, star, diamond, pyramid, arrow, rod, or conical-shapes. Also, the height and area of the traction members 122 may be the same or different. The bottom surface of the outsole 116 and traction members 122 can be made of any suitable material such as rubber or plastics and combinations thereof. Thermoplastics such as nylons, polyesters, polyolefins, and polyurethanes can be used. It should be understood that the above-described outsole 116 shown in FIG. 1E represents only one example of an outsole that can be used in the shoe 100 constructions of this disclosure and other outsole designs can be used without departing from the spirit and scope of this invention.

In some examples, the bottom surface of the outsole 116 may further include spikes or cleats 138 (shown in FIG. 4). The cleats 138 may provide additional traction between the shoe 100 and the ground surface. If such spikes or cleats 138 are present, they may be fastened to sockets or receptacles (not shown) in the outsole 116 or fixedly coupled to the outsole 116.

The insole 126 (shown in FIG. 1C), which may be worn inside the shoe 100, may be designed to provide cushioning or comfort for the wearer of the shoe 100. The insole 126 may be above the outsole 116 when in use. In some embodiments, the insole 126 may be designed to provide support. The insole 126 may be flexible, semi-rigid, or rigid. In some examples, the insole 126 may be removable.

The sole 106 may be attached to the upper 104 at a feather line 124 (shown in FIG. 1A), for example, using cement or the like and conventional techniques known to those skilled in the art. Prior to attachment to the sole 106, the upper 104 may be pulled onto a last, and a lasting board may be attached to the upper 104 with an adhesive. The lasting board may then be attached to the sole 106 with an adhesive for producing the shoe 100. It should be understood that the above-described sole 106 shown in FIGS. 1A-D represents only one example of a sole that can be used in the shoe 100 constructions of this disclosure; other soles can be used without departing from the spirit and scope of this invention.

With reference now to FIGS. 5A-D, different configurations of heel pads 134,234,334,434 in a heel cup 102 are described. As should be appreciated, height and distance dimensions as described with respect to FIGS. 5A-D may be measured in a direction that is substantially orthogonal to a plane formed by the sole or ground when the shoe 100 is at rest. For instance, height dimensions may be measured in a substantially vertical direction. Width and/or length dimensions may be measured in a direction that is substantially parallel to the plane formed by the sole or ground when the shoe 100 is at rest. For instance, the width and/or length dimensions may be measured in a direction that is substantially orthogonal to the direction of the height dimensions. As illustrated in FIGS. 5A-D, the heel cup 102 is in a flattened form and the dimensions are shown along an oblique plane, which when the shoe 100 is assembled and at rest on or parallel to a surface, may be in a vertical position.

Figure 5A:
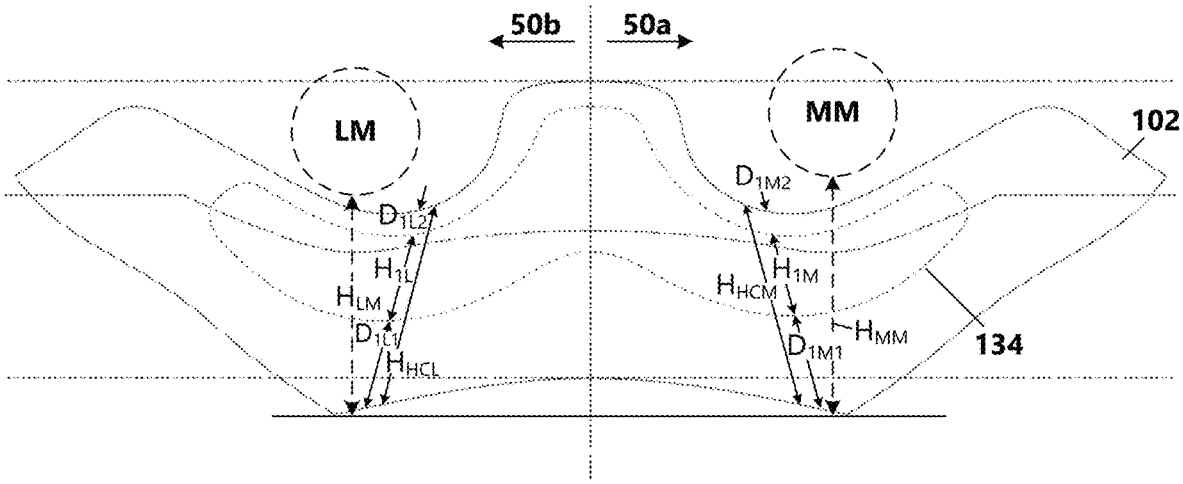
FIG. 5A depicts an inside (or front) view of an example single heel pad configuration.

As shown in FIG. 5A, in one example implementation, the heel cup 102 may include a single heel pad 134, wherein the single heel pad 134 may have an asymmetrical configuration about the medial side 50*a* and the lateral side 50*b* of the heel cup 102. In some examples, the heel pad 134 may be constructed to have a medial height $H_{1M}$ that is greater than its lateral height $H_{1L}$. For instance, the medial height $H_{1M}$ is a distance measured from a lowest point along the bottom edge of the medial side 50*a* of the heel pad 134 to a lowest point along the upper edge of the medial side 50*a* of the heel pad 134. The lateral height $H_{1L}$ is a distance measured from a lowest point along the bottom edge of the lateral side 50*b* of the heel pad 134 to a lowest point along the upper edge of the lateral side 50*b* of the heel pad 134. In some examples, the medial side 50*a* of the heel pad 134 may have a height 1-6 mm or 1-3 greater than height the lateral side 50*b* of the heel pad 134. For instance, the medial side 50*a* of the heel pad 134 may have a height $H_{1M}$ that is at least 1 mm greater than the height $H_{1L}$ of the lateral side 50*b* of the heel pad 134.

The difference in height may be dependent on the size of the shoe. For instance, a larger difference in height may be present for a larger shoe, and a smaller difference in height may be present for smaller shoe. As such, the differences in height may be better represented as a ratio between the medial height $H_{1M}$ and the lateral height $H_{1L}$. In some examples, ratio between the medial height $H_{1M}$ dimension to the lateral height $H_{1L}$ dimension is a ratio within a range of 1.05:1 to 1.5:1. As an illustrative example, for an average adult male shoe size, the medial height $H_{1M}$ of the heel pad 134 may be between 23.5-26.5 mm, and the lateral height $H_{1L}$ of the heel pad 134 may be 22-25 mm. Accordingly, the heel pad 134 may occupy a greater area on the medial side 50*a* to reduce the voids of space that can normally occur around the heel region in a shoe 100 due to the asymmetrical heights $H_{MM}$,$H_{LM}$ of the medial malleolus and the lateral malleolus.

In some examples and as shown in FIG. 5A, the heel cup 102 may have a symmetrical profile, wherein the medial height $H_{HCM}$ of a portion of the heel cup 102 that may be located below the wearer's medial malleolus (MM) may be equal to the lateral height $H_{HCL}$ of a portion of the heel cup 102 that may be located below the wearer's lateral malleolus (LM). For instance, the medial height $H_{HCM}$ is a distance measured from a bottom edge of the medial side 50*a* of the heel cup 102 to the lowest point of an upper edge of the medial side 50*a* of the heel cup 102. The lateral height $H_{HCL}$ is a distance measured from a bottom edge of the lateral side 50*b* of the heel cup 102 to the lowest point of an upper edge of the lateral side 50*b* of the heel cup 102. In other examples, the heel cup 102 may have an asymmetrical profile, wherein the medial height $H_{HCM}$ of the heel cup 102 is greater than the lateral height $H_{HCL}$ of the heel cup 102.

In some examples, to further provide a shoe 100 that may better fit the contour of the wearer's heel area for reducing foot movement during a golf swing, the heel pad 134 may be positioned such that the medial side 50*a* of the heel pad 134 may be 1-6 mm or 1-3 mm higher than the lateral side 50*b* of the heel pad 134. For example, a first medial distance $D_{1M1}$, measured from the bottom edge of the medial side 50*a* of the heel cup 102 to the lowest point of the bottom edge of the medial side 50*a* of the heel pad 134, may be less than a first lateral distance $D_{1L1}$ measured from the bottom edge of the lateral side 50*b* of the heel cup 102 to the lowest point of the bottom edge of the lateral side 50*b* of the heel pad 134. In some examples, the first medial distance $D_{1M1}$ dimension in comparison with the first lateral distance $D_{1L1}$ dimension is a ratio within a range of 1:1.05 to 1:1.5. As an illustrative example, for an average adult male shoe size, the first medial distance $D_{1M1}$ of the heel pad 134 be between 21-25 mm and the first lateral distance $D_{1L1}$ of the heel pad 134 may be between 22.5 and 26.5 mm.

In some examples, the heel pad 134 may be further positioned such that a second medial distance $D_{1M2}$, measured from the lowest point along the top edge of the medial side 50*a* of the heel cup 102 to the lowest point along the top edge of the medial side 50*a* of the heel pad 134, is equal to a second lateral distance $D_{1L2}$, measured from the lowest point along the top edge of the lateral side 50*b* of the heel cup 102 to the lowest point along the top edge of the lateral side 50*b* of the heel pad 134. In one illustrative example, for an average adult male shoe size, the second medial distance $D_{1M2}$ of the heel pad 134 and the second lateral distance $D_{1L2}$ of the heel pad 134 may be between 5-9 mm. It should be understood that the above-described single heel pad configuration shown in FIG. 5A represents only one example of a single heel pad configuration that can be used in the shoe 100 constructions of this disclosure and other single heel pad configuration designs can be used without departing from the spirit and scope of this invention. For example, in other implementations, the heel pad 134 may be constructed such that the lateral thickness is greater than the medial thickness. In other example implementations, the heel pad 134 may be constructed to extend farther along the lateral side 50*b* of the heel cup 102 than along the medial side 50*a* of the heel cup 102 (e.g., between 1-3 mm). In other example implementations, the distance $D_{1M2}$ measured from the lowest point along the top edge of the medial side 50*a* of the heel cup 102 to the lowest point along the top edge of the medial side 50*a* of the heel pad 134 may be less than the distance $D_{1L2}$ measured from the lowest point along the top edge of the lateral side 50*b* of the heel cup 102 to the lowest point along the top edge of the lateral side 50*b* of the heel pad 134. In some examples, the heel pad 134 may be constructed to extend farther to the top edge of the heel cup 102 on the medial side 50*a* of the heel cup 102 than on the lateral side 50*b* by 1-3 mm. In one illustrative example, for an average adult male shoe size, the medial distance $D_{1M2}$ dimension in comparison with the lateral distance $D_{1L2}$ dimension is a ratio within a range of 1:1.2 to 1:1.8. Other example asymmetrical single heel pad configurations are possible and are within the scope of the present disclosure.

Figure 5B:
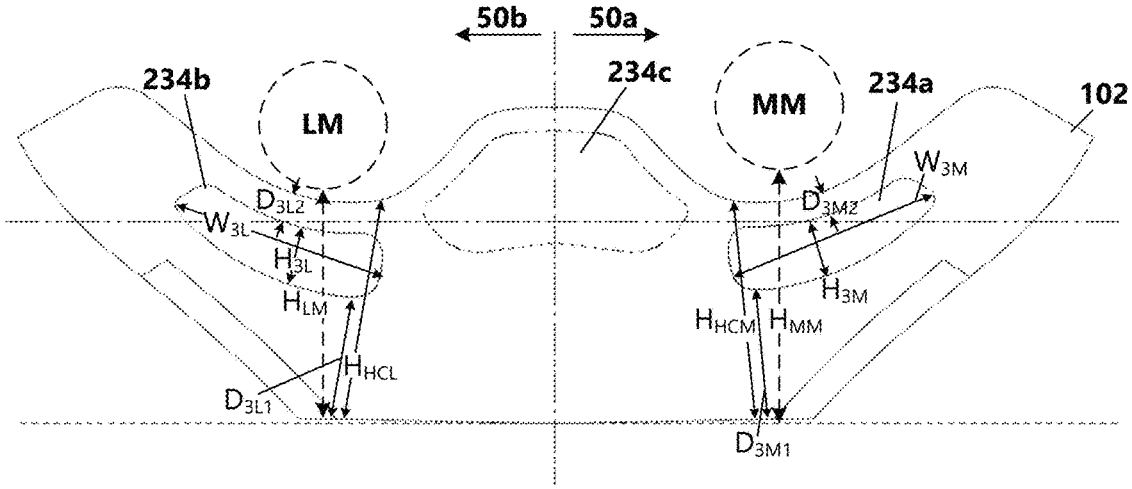
FIG. 5B depicts an inside (or front) view of an example multiple heel pad configuration including three (3) heel pads.

In another example implementation, the heel cup 102 may include a plurality of heel pads 234*a-n*, wherein the plurality of heel pads 234*a-n* may have an asymmetrical configuration about the medial side 50*a* and the lateral side 50*b* of the heel cup 102. As can be appreciated, utilizing a plurality of heel pads 234*a-n* may allow for a reduction of material used for the inner foam layer, which can reduce the weight of the shoe 100. For example, the plurality of heel pads 234*a-n* may be positioned within the profile of the single heel pad 134, but may be positioned with spaces between the pads. FIG. 5B shows an example heel cup 102 comprising a multiple heel pad configuration including three (3) heel pads 234*a-c*. For example, a first heel pad 234*a* may be positioned on the medial side 50*a* of the heel cup 102, and may be further positioned to fill a first void space defined between the heel cup 102 and the medial side of the wearer's foot below the wearer's medial malleolus. A second heel pad 234*b* may be positioned on the lateral side 50*b* of the heel cup 102, and may be further positioned to fill a second void space defined between the heel cup 102 and the lateral side of the wearer's foot below the wearer's lateral malleolus. A third heel pad 234*c* may be positioned in the center (i.e., between the medial side 50*a* and the lateral side 50*b*) of the heel cup 102.

In some examples and as shown in FIG. 5B, the heel cup 102 may have a symmetrical profile with an asymmetrical heel pad configuration. For instance, the top edge and the bottom edge of the heel cup may be substantially symmetrical on the medial and lateral sides, but the heel pad configuration may be asymmetrical on medial and lateral sides. As an example, the medial height $H_{HCM}$ of a portion of the heel cup 102 that may be located below the wearer's medial malleolus (MM) may be equal to the lateral height $H_{HCL}$ of a portion of the heel cup 102 that may be located below the wearer's lateral malleolus (LM). For instance, the medial height $H_{HCM}$ is a distance measured from a bottom edge of the medial side 50*a* of the heel cup 102 to the lowest point of the upper edge of the medial side 50*a* of the heel cup 102; and the lateral height $H_{HCL}$ is a distance measured from a bottom edge of the lateral side 50*b* of the heel cup 102 to the lowest point of the upper edge of the lateral side 50*b* of the heel cup 102. In one illustrative example, for an average adult male shoe size, the medial height $H_{HCM}$ of the heel cup 102 and the lateral height $H_{HCL}$ of the heel cup 102 may be between 61.5-65.5 mm. In other examples, the heel cup 102 may have an asymmetrical profile and an asymmetrical heel pad configuration.

In some examples, the first heel pad 234*a* and the second heel pad 234*b* may be constructed to have the same dimensions and may be arranged such that the first heel pad 234*a* is a mirror image of the second heel pad 234*b* and positioned in the heel cup 102 asymmetrically to the second heel pad 234*b* to reduce the voids of space that can normally occur around the heel region in a shoe 100 due to the asymmetrical heights $H_{MM}$,$H_{LM}$ of the wearer's medial malleolus and the lateral malleolus. For example, the first heel pad 234*a* may be constructed to have a same medial height $H_{3M}$ as the lateral height $H_{3L}$ of the second heel pad 234*b*. For instance, the medial height $H_{3M}$ of the first heel pad 234*a* may be measured from a lowest point along the bottom edge of the first heel pad 234*a* to a lowest point along the upper edge of the first heel pad 234*a*; and the lateral height $H_{1L}$ is a distance measured from a lowest point along the bottom edge of the second heel pad 234*b* to a lowest point along the upper edge of the second heel pad 234*b*. In one illustrative example, for an average adult male shoe size, the medial height $H_{3M}$ of the first heel pad 234*a* and the lateral height $H_{3L}$ of the second heel pad 234*b* may be between 14.5-18.5 mm.

In some examples, the first heel pad 234*a* may be further constructed to have a same medial width $W_{3M}$ as the lateral width $W_{3L}$ of the second heel pad 234*b*. For instance, the medial width $W_{3M}$ may be measured from the left edge (or back edge) of the first heel pad 234*a* to the right edge (or front edge) of the first heel pad 234*a* across a horizontal midline of the first heel pad 234*a*, and the lateral width $W_{3L}$ may be measured from the left edge (or front edge) of the second heel pad 234*b* to the right edge (or back edge) of the second heel pad 234*b* across a horizontal midline of the second heel pad 234*b*. The widths may be measured from edge to edge following the contour of the heel cup 102. In one illustrative example, for an average adult male shoe size, the medial width $W_{3M}$ of the first heel pad 234*a* and the lateral height $H_{3L}$ of the second heel pad 234*b* may be between 60-66 mm.

In some examples, to further provide a shoe 100 that may better fit the contour of the wearer's heel area for reducing foot movement during a golf swing, the first heel pad 234*a* may be positioned such that the first heel pad 234*a* may be positioned such that the first heel pad 234*a* may be 1-6 mm or 1-3 mm higher than the second heel pad. For example, a first medial distance $D_{3M1}$ measured from the bottom edge of the medial side 50*a* of the heel cup 102 to the lowest point along the bottom edge of the first heel pad 234*a* may be greater than a first lateral distance $D_{3L1}$ measured from the bottom edge of the lateral side 50*b* of the heel cup 102 to the lowest point along the bottom edge of the second heel pad 234*b*. In some examples, the first medial distance $D_{3M1}$ dimension in comparison with the first lateral distance $D_{3L1}$ dimension is a ratio within a range of 1:1.05 to 1:1.5. As an illustrative example, the first medial distance $D_{3M1}$ of the first heel pad 234*a* may be between 36.5-40.5 mm and the first lateral distance $D_{3L1}$ of the second heel pad 234*b* may be between 34.5-38.5 mm.

In some examples, the first heel pad 234*a* may be further positioned such that the first heel pad 234*a* may be 1-3 mm higher than the second heel pad 234*b*. For example, a second medial distance $D_{3M2}$ measured from the lowest point along the top edge of the medial side 50*a* of the heel cup 102 to the lowest point along the top edge of the first heel pad 234*a* may be less than a second lateral distance $D_{3L2}$ measured from the lowest point along the top edge of the lateral side 50*b* of the heel cup 102 to the lowest point along the top edge of the second heel pad 234*b*. In some examples, the second medial distance $D_{3M1}$ dimension in comparison with the second lateral distance $D_{3L1}$ dimension is a ratio within a range of 1:1.1 to 1:1.5. In one illustrative example, for an average adult male shoe size, the second medial distance $D_{3M2}$ of the first heel pad 234*a* may be between 5-9 mm and the second lateral distance $D_{3L2}$ of the second heel pad 234*b* may be between 7-11 mm.

It should be understood that the above-described multiple heel pad configuration shown in FIG. 5B represents only one example of a multiple heel pad configuration that can be used in the shoe 100 constructions of this disclosure and other multiple heel pad configuration designs can be used without departing from the spirit and scope of this invention. For instance, in other examples, the multiple heel pad configuration may be constructed such that the thickness of the second heel pad 234*b* has a lateral thickness is greater than the medial thickness of the first heel pad 234*a*. In other examples, the multiple heel pad configuration may be constructed such that the width $W_{3L}$ of the second heel pad 234*b* may be greater than the width $W_{3M}$ of the first heel pad 234*a* and may extend farther along (e.g., 1-3 mm) the lateral side 50*b* of the heel cup 102 than along the medial side 50*a* of the heel cup 102. In other examples, the first heel pad 234*a* may be constructed of a different material than the second heel pad 234*b*. For example, the material of the second heel pad 234*b* (i.e., located on the lateral side 50*b* of the heel cup 102) may have a density higher than a density of the material of the first heel pad 234*a* (located on the medial side 50*a* of the heel cup 102). In other examples, other multiple heel pad configurations may be utilized.

Figure 5C:
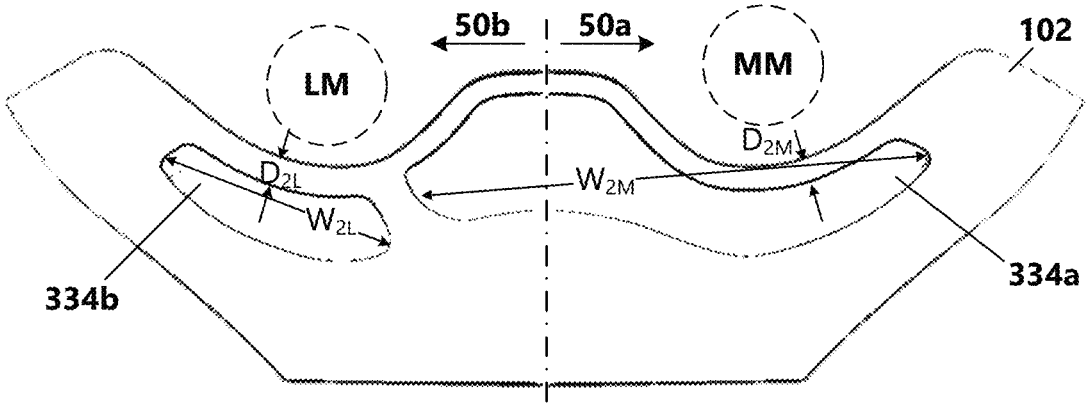
FIG. 5C depicts an inside (or front) view of an example multiple heel pad configuration including two (2) heel pads.

For example and as shown in FIG. 5C, another multiple heel pad configuration may include two (2) heel pads 334*a,b* having an asymmetrical configuration about the medial side 50*a* and the lateral side 50*b* of the heel cup 102. According to one example, a first heel pad 334*a* may be positioned on the medial side 50*a* of the heel cup 102 and may be constructed to fill a first void space defined between the heel cup 102 and the medial side of the wearer's foot below the wearer's medial malleolus, and a second heel pad 334*b* may be positioned on the lateral side 50*b* of the heel cup 102 and constructed to fill a second void space defined between the heel cup 102 and the lateral side of the wearer's foot below the wearer's lateral malleolus. According to an aspect, the first heel pad 334*a* may have a width $W_{2M}$ greater than the width $W_{2L}$ of the second heel pad 334*b*, and may be constructed to extend around the back of the heel cup 102 (e.g., around the back of the wearer's ankle) onto a portion of the lateral side 50*b* of the heel cup 102. For instance, the medial width $W_{2M}$ may be measured from the left edge of the first heel pad 334*a* to the right edge of the first heel pad 334*a* across the horizontal midline, and the lateral width $W_{2L}$ may be measured from the left edge of the second heel pad 334*b* to the right edge of the second heel pad 334*b* across the horizontal midline. In some examples, the medial width $W_{2M}$ dimension in comparison with the width $W_{2L}$ dimension is a ratio within a range of 1.3:1 to 2:1.

In some examples, the first heel pad 334*a* in a two (2) heel pad configuration may be positioned such that the first heel pad 334*a* may be 1-3 mm higher than the second heel pad 234*b*. For example, a medial distance $D_{2M}$ measured from the lowest point along the top edge of the medial side 50*a* of the heel cup 102 to the lowest point along the top edge of the first heel pad 334*a* is less than the lateral distance $D_{2L}$ measured from the lowest point along the top edge of the lateral side 50*b* of the heel cup 102 to the lowest point along the top edge of the second heel pad 334*b*. In some examples, the medial distance $D_{2M}$ dimension in comparison with the lateral distance $D_{2L}$ dimension is a ratio within a range of 1:1.05 to 1:1.5. In one illustrative example, the medial distance $D_{2M}$ of the first heel pad 334*a* may be between 5-9 mm and the lateral distance $D_{2L}$ of the second heel pad 334*b* may be between 7-11 mm.

Figure 5D:
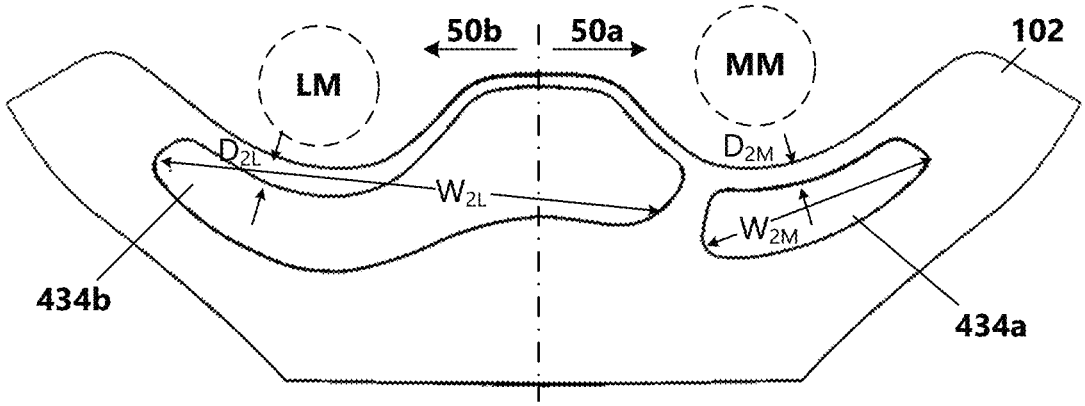
FIG. 5D depicts an inside (or front) view of another example multiple heel pad configuration including two (2) heel pads.

According to another example, another multiple heel pad configuration including two (2) heel pads 434*a,b* is shown in FIG. 5D. For example, a first heel pad 434*a* may be positioned on the medial side 50*a* of the heel cup 102 and may be constructed to fill a first void space defined between the heel cup 102 and the medial side of the wearer's foot below the wearer's medial malleolus, and a second heel pad 434*b* may be positioned on the lateral side 50*b* of the heel cup 102 and constructed to fill a second void space defined between the heel cup 102 and the lateral side of the wearer's foot below the wearer's lateral malleolus. According to an aspect, the first heel pad 434*a* may have a width $W_{2M}$ less than the width $W_{2L}$ of the second heel pad 434*b*, wherein the second heel pad 434*b* may be constructed to extend around the back of the heel cup 102 (e.g., around the back of the wearer's ankle) onto a portion of the medial side 50*a* of the heel cup 102. For instance, the medial width $W_{2M}$ may be measured from the left edge of the first heel pad 434*a* to the right edge of the first heel pad 434*a* across the horizontal midline of the first heel pad 434*a*, and the lateral width $W_{2L}$ may be measured from the left edge of the second heel pad 434*b* to the right edge of the second heel pad 434*b* across the horizontal midline of the second heel pad 434*b*. In some examples, the medial width $W_{2M}$ dimension in comparison with the lateral width $W_{2L}$ dimension is a ratio within a range of 1:1.25 to 1:2.

In some examples, the first heel pad 434*a* in a two (2) heel pad configuration may be positioned such that the first heel pad 434*a* may be 1-3 mm higher than the second heel pad 434*b*. For instance, a medial distance $D_{2M}$ measured from the lowest point along the top edge of the medial side 50*a* of the heel cup 102 to the top lowest point along the edge of the first heel pad 434*a* may be less than the lateral distance $D_{2L}$ measured from the lowest point along the top edge of the lateral side 50*b* of the heel cup 102 to the lowest point along the top edge of the second heel pad 434*b*. In some examples, the medial distance $D_{2M}$ dimension in comparison with the lateral distance $D_{2L}$ dimension is a ratio within a range of 1:1.05 to 1:1.5. In one illustrative example, the medial distance $D_{2M}$ of the first heel pad 434*a* may be between 5-9 mm and the lateral distance $D_{2L}$ of the second heel pad 434*b* may be between 7-11 mm. Other example asymmetrical multiple heel pad configurations are possible and are within the scope of the present disclosure.

According to an aspect, the size and configuration of the heel pad(s) 134,234,334,434 may be based on the size of the shoe 100. In some examples, a first size and heel pad 134,234,334,434 configuration may be associated with a first range of shoe 100 sizes, a second size and heel pad 134,234,334,434 configuration may be associated with a second range of shoe 100 sizes, and so on. In other examples, heel pads 134,234,334,434 may be sized and configured based on the specific wearer. For example, the locations and sizes of the pads may be based on various measurements of a wearer's foot. One example measurement may include measurements of the distances from a standing surface to the wearer's medial malleolus and lateral malleolus or, more generally, the difference in height between the wearer's medial malleolus and lateral malleolus.

Figure 6:
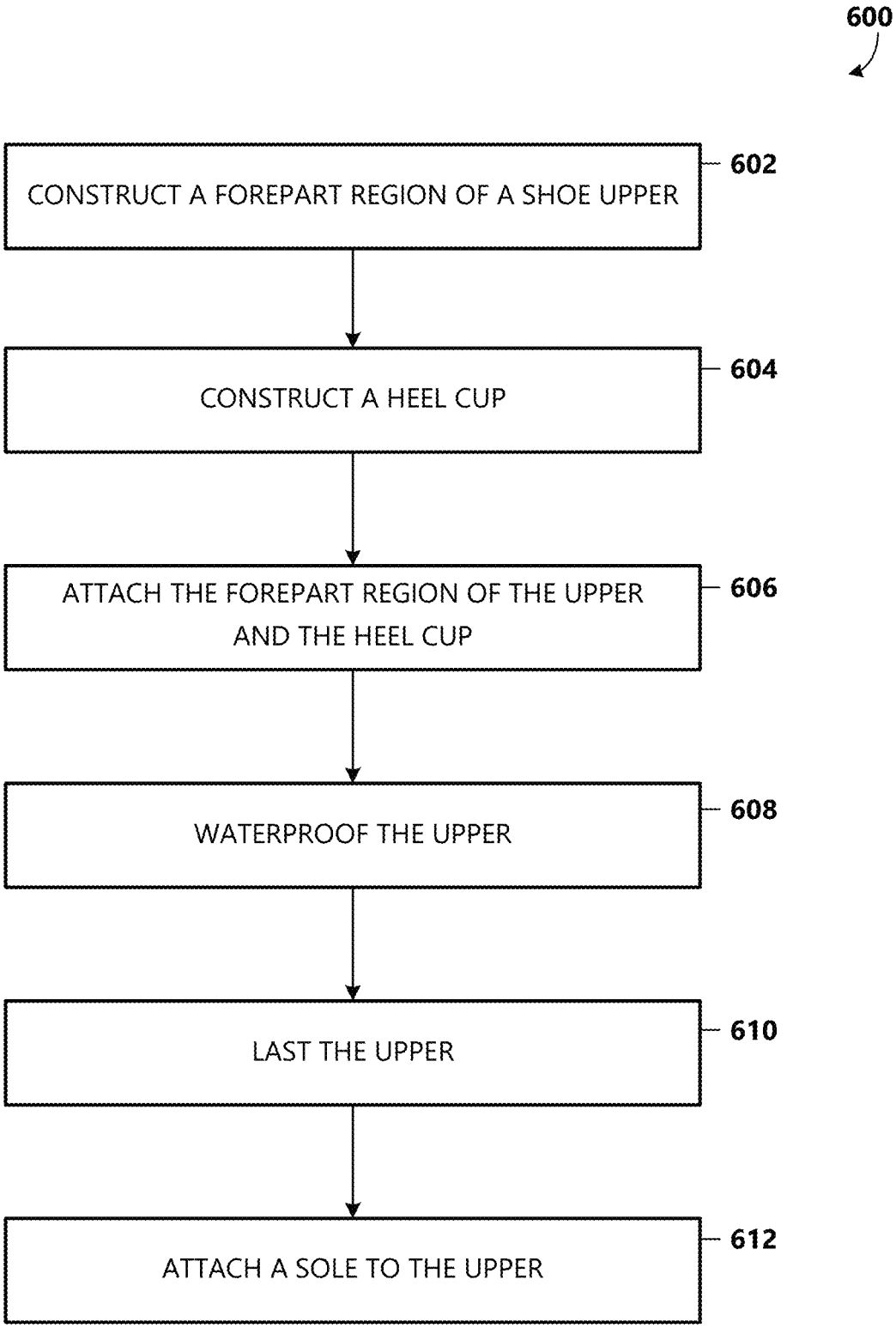
FIG. 6 depicts example operations of a method of making a golf shoe comprising an asymmetrical heel pad configuration according to an embodiment.

FIG. 6 depicts a flow chart having example operations of a method 600 of making a golf shoe 100 comprising an asymmetrical heel pad configuration according to an embodiment. At OPERATION 602, a forepart region of a shoe upper 104 may be constructed. As described above, the forepart region of the upper 104 may include a vamp 108, an eye stay 112, and a tongue member 110. In some examples, the vamp 108, eye stay 112, and tongue member 110 may be stitched or otherwise attached together.

At OPERATION 604, a heel region of the shoe upper 104 may be constructed. According to an example, the heel region may include a heel cup 102. Accordingly, operation 604 may include constructing the heel cup 102. For example, in OPERATION 604, various layers may be molded together to form the heel cup 102, as discussed herein. One example method for constructing the heel cup 102 is described below with reference to FIG. 7.

At OPERATION 606, the forepart region of the upper 104 and the heel cup 102 may be attached. According to one example, the forepart region of the upper 104 may be stitched or otherwise attached to the heel cup 102 to form the upper 104.

In some implementations, at OPERATION 608, the upper 104 may be waterproofed. For example, a method may be performed for waterproofing the stitching or attachment interface between the heel cup 102 and the forepart region of the upper 104. One example method for waterproofing the upper 104 is described below with reference to FIG. 8.

At OPERATION 610, the upper 104 may be lasted. According to one example, a board lasting operation may be performed, wherein the upper 104 may be stretched over a last or lasting machine, and then bonded to a paper fiber or other type of board. In some examples, a buffing process may be performed to smooth the material of the upper 104 underneath the board.

At OPERATION 612, a sole 106 may be attached to the upper 104. For example, the board may be bonded to an outsole 116, and in some examples, an insole 126 may be inserted into the shoe 100.

Figure 7:
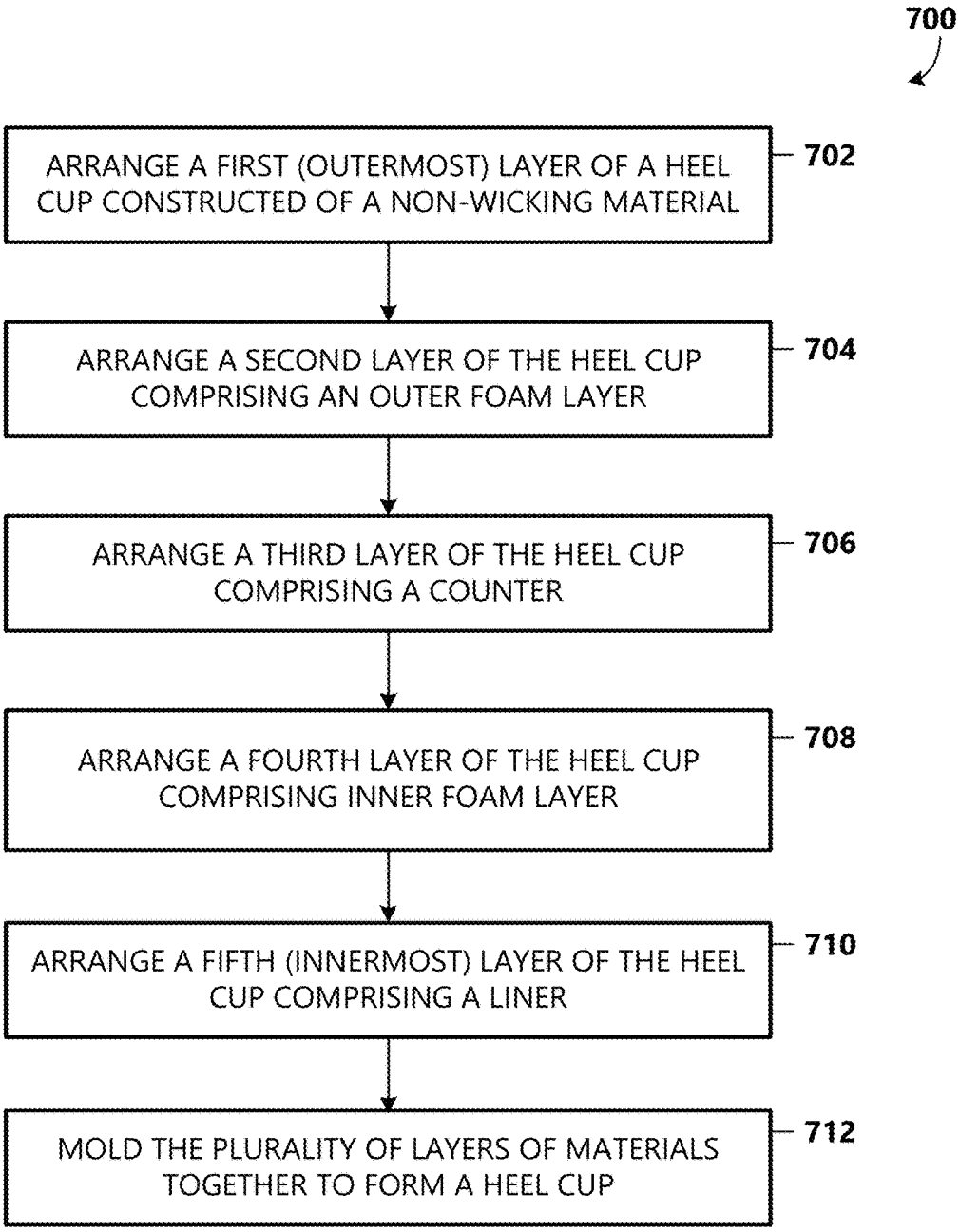
FIG. 7 depicts example operations of a method of constructing an asymmetrically configured heel pad according to an embodiment.

With reference now to FIG. 7, example operations of a method 700 of constructing an asymmetric heel cup 102 are depicted. For example, the method 700 may be performed as part of OPERATION 604 of method 600. The method 700 may start at OPERATION 702, where a first layer of the heel cup 102 may be arranged. For example, the first layer, which may be the outermost layer of the heel cup 102, may be a non-wicking material 128 that does not absorb moisture as part of providing a waterproof shoe 100.

At OPERATION 704, a next, or second, layer of the heel cup 102 may be arranged and placed in contact with the first layer. For example, the second layer may include an outer foam layer 130 to provide an embossed decorative pattern in the heel cup 102 when the various layers of the heel cup 102 are arranged and molded together.

At OPERATION 706, a third layer of the heel cup 102 may be arranged and placed in contact with the second layer. For example, the third layer may include a counter 132 to reinforce the heel cup 102.

At OPERATION 708, a fourth layer of the heel cup 102 may be arranged and placed in contact with the third layer. For example, the fourth layer may include an inner foam layer. When molded, the inner foam layer includes at least one or a plurality of heel pads 134,234,334,434 configured asymmetrically about the medial side 50*a* and the lateral side 50*b* of the heel cup 102 to reduce the voids of space that can normally occur around the heel region in a shoe 100 due to the asymmetrical heights $H_{MM}$,$H_{LM}$ of the wearer's medial malleolus and the lateral malleolus.

At OPERATION 710, a fifth, or last layer, which may be the innermost layer of the heel cup 102, may be arranged and placed in contact with the fourth layer. For example, the fifth layer may include a lining 136 that may be used to line the inside of the heel cup 102 and improve comfort of the shoe 100. Once all the layers are arranged or placed together, a multi-layer pre-molded material is formed.

At OPERATION 721, the various layers (e.g., the multi-layer pre-molded material) may be molded together using molding techniques to form the heel cup 102 with the asymmetric heel pads discussed herein. For instance, compression molding techniques may used to mold the multi-layer pre-molded material into the heel cup 102. As an example, the multi-layer pre-molded material may be placed into a heated mold cavity. The mold may then be closed and compressed to form the heel cup 102 with the heel pads positioned and formed as discussed herein.

Figure 8:
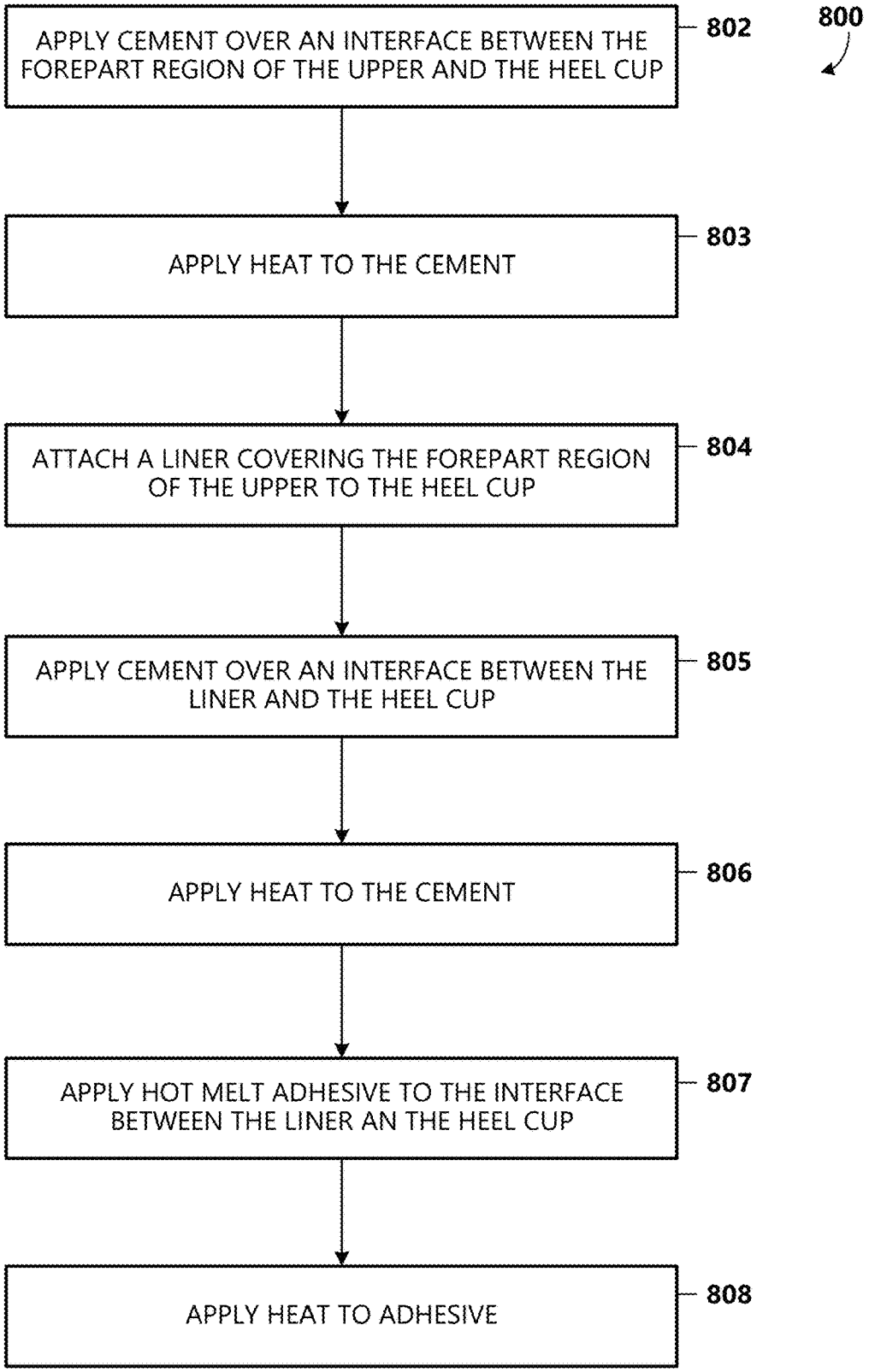
FIG. 8 depicts example operations of a method of waterproofing a shoe upper according to an embodiment.

With reference now to FIG. 8, example operations of a method 800 of waterproofing a shoe upper 104 are depicted. For example, the method 800 may be performed as part of OPERATION 608 of method 600. The method 800 may start at OPERATION 802, where cement 144 or another sealant be applied over the seam or other interface (i.e., first stitching 140) where the forepart region of the shoe upper 104 and the heel cup 102 are connected. For example, the cement 144 may be applied to the interior surface of the interface to fill any holes that may be formed in the process of attaching (e.g., stitching) the forepart region of the shoe upper 104 to the heel cup 102. In some examples, at OPERATION 803, heat may be applied (e.g., the upper 104 may be put into a heat tunnel) to seal the cement 144.

At OPERATION 804, a liner 146 may be attached to the inner side of the forepart region of the upper 104 extending from the toe area of the shoe 100 to the heel cup 102, and then secured to the heel cup 102 via a second stitching 142. For example, the liner 146 may cover the cement 144 applied over the first stitching 140.

At OPERATION 805, another layer of cement 144 may be applied to the interior surface over the second stitching 142 to fill any holes made as part of the stitching. At OPERATION 806, heat may be applied (e.g., the upper 102 may be put into a heat tunnel) to seal the cement 144.

At OPERATION 807, hot melt adhesive 148 may additionally be applied over the second stitching 142 to cover the cement 144 applied over the second stitching 142. In some examples, the hot melt adhesive may be a type of tape. At OPERATION 808, heat may be applied to the hot melt adhesive to create a waterproof seal over the second stitching 142 and to provide a waterproof shoe 100.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

It also should be understood the terms, "first", "second", "third", "fourth", "fifth", "sixth", "seventh", "eight", "ninth", "tenth", "eleventh", "twelfth", "top", "bottom", "upper", "lower", "upwardly", "downwardly", "right', "left", "center", "middle", "proximal", "distal", "anterior", "posterior", "forefoot", "mid-foot", and "rear-foot", and the like are arbitrary terms used to refer to one position of an element based on one perspective and should not be construed as limiting the scope of the invention.

All patents, publications, test procedures, and other references cited herein, including priority documents, are fully incorporated by reference to the extent such disclosure is not inconsistent with this invention and for all jurisdictions in which such incorporation is permitted. It is understood that the shoe materials, designs, constructions, and structures; shoe components; and shoe assemblies and sub-assemblies described and illustrated herein represent only some embodiments of the invention. It is appreciated by those skilled in the art that various changes and additions can be made to such products and materials without departing from the spirit and scope of this invention. It is intended that all such embodiments be covered by the appended claims.

What is claimed is:

1. A golf shoe comprising:

an upper, the upper comprising:

a forepart region; and a heel cup attached to the forepart region, the heel cup comprising:

an interior surface;

an exterior surface; and a plurality of distinct heel pads molded between the interior surface and the exterior surface, the plurality of heel pads comprising a medial side and a lateral side, wherein the medial side is asymmetrical in shape or position to the lateral side; and a sole attached to the upper, wherein the plurality of heel pads comprises:

a first heel pad comprising the medial side of the plurality of heel pads; and a second heel pad comprising the lateral side of the plurality of heel pads and being entirely separated from the first heel pad, and wherein the first and second heel pads are shaped and positioned such that a lowest point along a top edge of the first heel pad is to be below the medial malleolus of a wearer, and such that a lowest point along a top edge of the second heel pad is to be below the lateral malleolus of the wearer.

2. The golf shoe of claim 1, wherein:

at least a portion of the medial side of the plurality of heel pads is positioned to fill a first void space defined between the interior surface of the heel cup and a medial side of the wearer's foot below the wearer's medial malleolus; and at least a portion of the lateral side of the plurality of heel pads is positioned to fill a second void space defined between the interior surface of the heel cup and a lateral side of the wearer's foot below the wearer's lateral malleolus.

3. The golf shoe of claim 1, wherein the medial side of the plurality of heel pads is positioned such that a distance from a lowest point along a bottom edge of the medial side of the plurality of heel pads to a bottom edge of a medial side of the heel cup is greater than a distance from a lowest point along the bottom edge of the lateral side of the plurality of heel pads to a bottom edge of a lateral side of the heel cup.

4. The golf shoe of claim 1, wherein a distance measured from a lowest point along a top edge of a medial side of the heel cup to a lowest point along the top edge of the medial side of the plurality of heel pads is greater than a distance measured from a lowest point along a top edge of a lateral side of the heel cup to a lowest point along a top edge of the lateral side of the plurality of heel pads.

5. The golf shoe of claim 1, wherein:

a distance measured from a lowest point along a top edge of a medial side of the heel cup to a lowest point along the top edge of the medial side of the plurality of heel pads is substantially equal to a distance measured from a lowest point along a top edge of a lateral side of the heel cup to a lowest point along a top edge of the lateral side of the plurality of heel pads; and a distance measured from a lowest point along a bottom edge of the medial side of the plurality of heel pads to the lowest point along the top edge of the medial side of the plurality of heel pads is greater than a distance measured from a lowest point along a bottom edge of the lateral side of the plurality of heel pads to the lowest point along the top edge of the lateral side of the plurality of heel pads.

6. The golf shoe of claim 1, wherein the medial side of the plurality of heel pads is positioned such that a distance measured from a lowest point along a top edge of the medial side of the plurality of heel pads to a lowest point along a top edge of a medial side of the heel cup is less than a distance measured from a lowest point along a top edge of the lateral side of the plurality of heel pads to a lowest point along a top edge of a lateral side of the heel cup.

7. The golf shoe of claim 1, wherein the plurality of heel pads further comprises a third heel pad positioned between the first heel pad and the second heel pad.

8. The golf shoe of claim 1, wherein the first heel pad has a thickness less than a thickness of the second heel pad.

9. The golf shoe of claim 1, wherein a width of the first heel pad is less than a width of the second heel pad, such that the second heel pad extends farther along a lateral side of the heel cup than the first heel pad extends along a medial side of the heel cup.

10. The golf shoe of claim 1, wherein the first heel pad is constructed of a different material than that of the second heel pad.

11. The golf shoe of claim 10, wherein the material of the second heel pad has a density higher than a density of the material of the first heel pad.

12. The golf shoe of claim 1, wherein the exterior surface of the heel cup is a non-wicking material.

13. The golf shoe of claim 12, further comprising:

a first stitching attaching the heel cup to the forepart region;

at least one layer of cement applied over the first stitching;

a liner covering the at least one layer of cement and attached to the heel cup via a second stitching;

at least one layer of cement applied over the second stitching; and hot melt adhesive further applied over the second stitching.

14. The golf shoe of claim 1, wherein two layers adjacent to the first and second heel pads, and that at least partially envelop the first and second heels pads, directly contact each other in a region between the first and second heel pads.

15. A method for making the golf shoe of claim 1, comprising:

constructing the forepart region of the upper;

constructing a heel region of the upper, the heel region comprising the heel cup;

attaching the forepart region to the heel cup to form the upper;

lasting the upper; and attaching the sole to the upper.

16. The method of claim 15, wherein constructing the heel region comprises:

arranging a first layer constructed of a non-wicking material, wherein the first layer is an exterior surface of the heel cup;

arranging, in contact with the first layer, a second layer comprising an outer foam layer;

arranging, in contact with the second layer, a third layer comprising a counter;

arranging, in contact with the third layer, a fourth layer comprising an inner foam layer;

arranging, in contact with the fourth layer, a fifth layer comprising a liner, wherein the fifth layer is an interior surface of the heel cup; and molding the layers together to form the heel cup.

17. The method of claim 15, further comprising waterproofing the upper, wherein waterproofing the upper comprises:

applying at least one layer of cement over a first stitching attaching the forepart region to the heel cup;

applying heat to the at least one layer of cement;

attaching a liner covering the at least one layer of cement with a second stitching;

applying another layer of cement over the second stitching;

applying hot melt adhesive over the second stitching; and applying heat to the hot melt adhesive.

18. A heel cup, comprising:

an interior surface;

an exterior surface; and at least one heel pad molded between the interior surface and the exterior surface, the at least one heel pad comprising a medial side and a lateral side, wherein the medial side of the at least one heel pad is asymmetrical to the lateral side of the at least one heel pad, wherein a distance measured from a lowest point along a top edge of a medial side of the heel cup to a lowest point along a top edge of the medial side of the at least one heel pad is substantially equal to, or less than, a distance measured from a lowest point along a top edge of a lateral side of the heel cup to a lowest point along a top edge of the lateral side of the at least one heel pad, and wherein a distance measured from a lowest point along a bottom edge of the medial side of the at least one heel pad to the lowest point along the top edge of the medial side of the at least one heel pad is greater than a distance measured from a lowest point along a bottom edge of the lateral side of the at least one heel pad to the lowest point along the top edge of the lateral side of the at least one heel pad.

19. The heel cup of claim 18, wherein the at least one heel pad comprises a plurality of distinct heel pads, the plurality of heel pads comprising:

a first heel pad comprising the medial side; and a second heel pad comprising the lateral side and being entirely separated from the first heel pad.

20. The heel cup of claim 19, comprising:

a first layer constructed of a non-wicking material, wherein the first layer is the exterior surface of the heel cup;

a second layer comprising an outer foam layer;

a third layer comprising a counter;

a fourth layer comprising the at least one heel pad; and a fifth layer comprising a liner, wherein the fifth layer is the interior surface of the heel cup.

21. A heel cup, comprising:

an interior surface;

an exterior surface; and at least one heel pad molded between the interior surface and the exterior surface, the at least one heel pad comprising a medial side and a lateral side, wherein the medial side of the at least one heel pad is asymmetrical to the lateral side of the at least one heel pad, wherein the medial side of the at least one heel pad is positioned such that:

a distance from a lowest point along a bottom edge of the medial side of the at least one heel pad to a bottom edge of a medial side of the heel cup is greater than a distance from a lowest point along the bottom edge of the lateral side of the at least one heel pad to a bottom edge of a lateral side of the heel cup; or a distance measured from a lowest point along a top edge of the medial side of the at least one heel pad to a lowest point along a top edge of a medial side of the heel cup is less than a distance measured from a lowest point along a top edge of the lateral side of the at least one heel pad to a lowest point along a top edge of a lateral side of the heel cup.

22. The heel cup of claim 21, wherein the at least one heel pad comprises a plurality of distinct heel pads, the plurality of heel pads comprising:

a first heel pad comprising the medial side; and a second heel pad comprising the lateral side and being entirely separated from the first heel pad.

* * * * *